US012589961B2

(12) United States Patent
Hanaoka et al.

(10) Patent No.: US 12,589,961 B2
(45) Date of Patent: Mar. 31, 2026

(54) MEDIUM TRANSPORT APPARATUS, MEDIUM PROCESSING APPARATUS, AND RECORDING APPARATUS

(71) Applicant: SEIKO EPSON CORPORATION, Tokyo (JP)

(72) Inventors: Keita Hanaoka, Shiojiri (JP); Tetsuji Yatsunami, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 22 days.

(21) Appl. No.: 18/657,868

(22) Filed: May 8, 2024

(65) Prior Publication Data

US 2024/0375897 A1 Nov. 14, 2024

(30) Foreign Application Priority Data

May 9, 2023 (JP) ..... 2023-077089

(51) Int. Cl.
*B65H 5/06* (2006.01)
*B65H 7/00* (2006.01)

(52) U.S. Cl.
CPC ..... *B65H 5/062* (2013.01); *B65H 7/00* (2013.01); *B65H 2404/14* (2013.01)

(58) Field of Classification Search
CPC ..... B65H 5/062; B65H 7/00; B65H 2404/14
See application file for complete search history.

(56) References Cited

U.S. PATENT DOCUMENTS 6,011,948 A 1/2000 Amano
7,980,556 B2 * 7/2011 Mizuno ..... B65H 9/006 271/902
8,123,217 B2 * 2/2012 Otaka ..... B65H 9/004 271/244
8,342,519 B2 * 1/2013 Watanabe ..... B65H 5/06 271/245
8,387,975 B2 * 3/2013 Suzuki ..... B65H 7/02 271/265.01
8,439,358 B2 * 5/2013 Watanabe ..... B65H 9/06 271/245

(Continued)

FOREIGN PATENT DOCUMENTS

JP H09-183539 A 7/1997
JP H11-011745 A 1/1999

*Primary Examiner* — Thomas A Morrison
(74) *Attorney, Agent, or Firm* — WORKMAN NYDEGGER

(57) ABSTRACT

A medium transport apparatus includes: a first and second route members that constitute a medium transport route; a transport roller pair that nips and feeds a medium being transported between the first and second route members and includes a first and second rollers that nip the medium therebetween; and a gate switchable between a first and second states. In the first state, the gate closes the medium transport route at a location upstream, in a medium transport direction, of a nip location at which the transport roller pair nips the medium. In the second state, the gate opens the medium transport route. The gate is disposed on a rotating member rotatable around a first rotating shaft, which is a rotating shaft for the first roller. The first rotating shaft engages with a fixed member, which is fixed to both the first route member and the second route member.

12 Claims, 16 Drawing Sheets

(56) References Cited

U.S. PATENT DOCUMENTS

| | | | | |
|---|---|---|---|---|
| 8,459,642 | B2 * | 6/2013 | Suzuki | B65H 9/004 271/226 |
| 8,807,559 | B2 * | 8/2014 | Osada | B65H 9/06 271/245 |
| 9,027,923 | B2 * | 5/2015 | Suzuki | G03G 15/6567 271/242 |
| 2008/0145128 | A1 * | 6/2008 | Lee | B65H 9/004 400/630 |
| 2008/0164652 | A1 * | 7/2008 | Otsuki | B29C 45/0053 264/129 |

* cited by examiner

MEDIUM TRANSPORT APPARATUS, MEDIUM PROCESSING APPARATUS, AND RECORDING APPARATUS

The present application is based on, and claims priority from JP Application Serial Number 2023-077089, filed May 9, 2023, the disclosure of which is hereby incorporated by reference herein in its entirety.

BACKGROUND

1. Technical Field

The present disclosure relates to a medium transport apparatus that transports a medium and further relates to a medium processing apparatus and a recording apparatus each of which is equipped with such a medium transport apparatus.

2. Related Art

Some printers and facsimiles are equipped with medium transport apparatuses configured to correct skew of a medium being transported. As an example of such apparatuses, JP-A-9-183539 discloses a sheet transport apparatus in which a shutter member is disposed so as to rotatable around a rotating shaft of a transport roller. When a leading edge of a sheet being transported comes into contact with the shutter member, this sheet becomes looped in a predetermined shape. In response, the shutter member rotates to move away from the sheet, thereby permitting the sheet to pass by the shutter member. According to this sheet transport apparatus, when the leading edge of the sheet being transported comes into contact with the shutter member, the sheet becomes looped so that the leading edge becomes aligned with a side of the shutter member. In this way, the sheet transport apparatus corrects the skew of the sheet.

In the above sheet transport apparatus, the leading edge of the sheet may accidentally come into contact with any other member before coming into contact with the shutter member. If the leading edge of the sheet comes into contact with any other member before coming into contact with the shutter member, the leading edge of the sheet may become misaligned from the side of the shutter member. In such cases, the sheet transport apparatus might fail to precisely correct the skew of the sheet. To appropriately bring the leading edge of a sheet into contact with the shutter member, it is necessary to consider the positional relationships between the shutter member and some route members that constitute the sheet transport route. The above document, unfortunately, fails to suggest or teach the importance of those positional relationships.

SUMMARY

The present disclosure is a medium transport apparatus that includes: a first route member disposed so as to face a first surface of a medium; a second route member disposed so as to face a second surface of the medium which is opposite to the first surface, both the first route member and the second route member constituting a medium transport route therebetween; a transport roller pair that nips and feeds the medium being transported between the first route member and the second route member and includes a first roller that comes into contact with the first surface of the medium and a second roller that comes into contact with the second surface of the medium; and a gate that is switchable between a first state and a second state, the first state being a state in which the gate closes the medium transport route at a location upstream, in a medium transport direction, of a nip location at which the transport roller pair nips the medium, the second state being a state in which the gate opens the medium transport route. The gate is disposed on a rotating member that is rotatable around a first rotating shaft, which is a rotating shaft for the first roller. The first rotating shaft engages with a fixed member. Both the first route member and the second route member are fixed to the fixed member.

DESCRIPTION OF EMBODIMENTS

Figure 1:
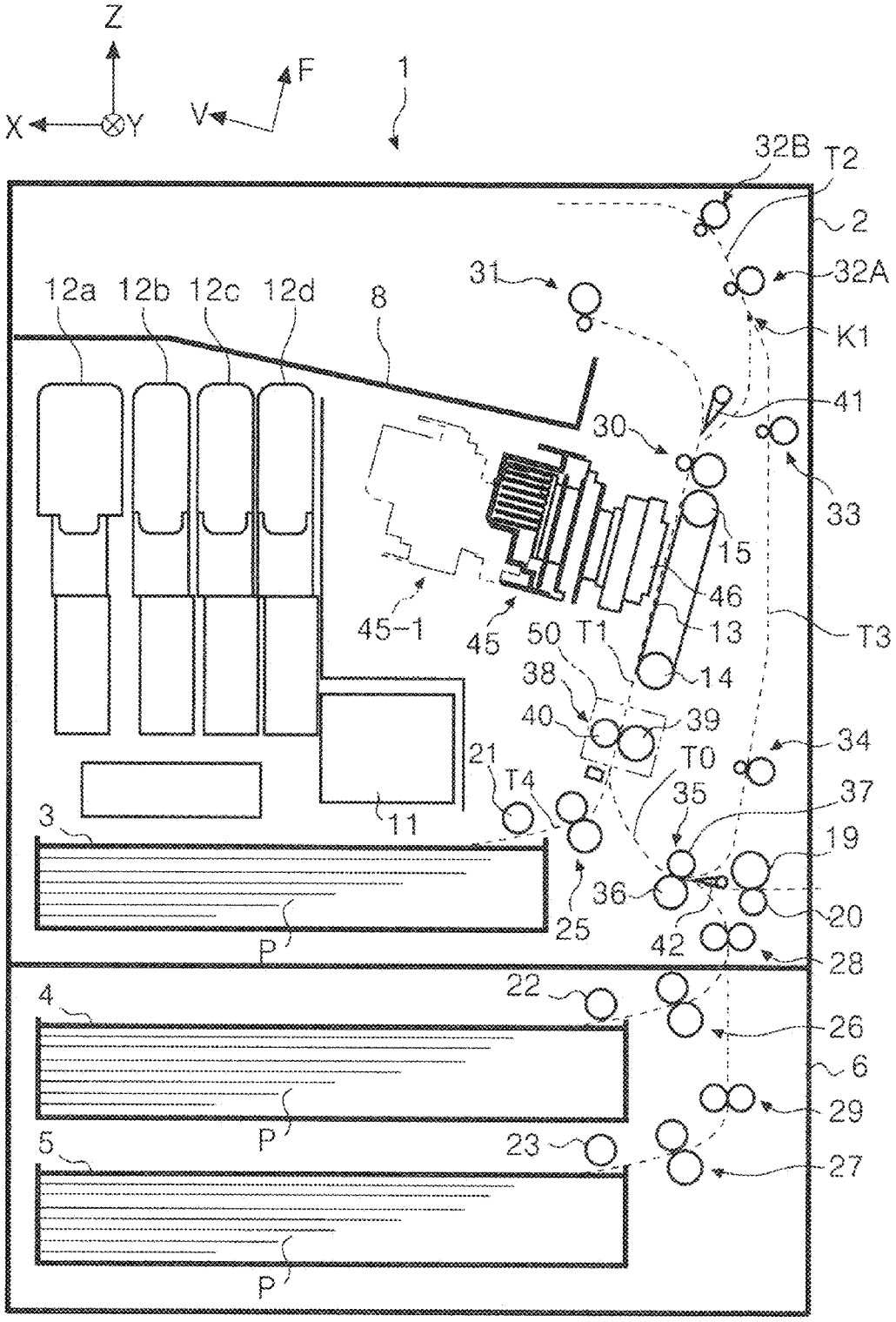
FIG. 1 illustrates an entire medium transport route in a printer according to an embodiment of the present disclosure.

Some aspects of the present disclosure will be described briefly below. According to a first aspect of the present disclosure, a medium transport apparatus includes: a first route member disposed so as to face a first surface of a medium; a second route member disposed so as to face a second surface of the medium which is opposite to the first surface, both the first route member and the second route member constituting a medium transport route therebetween; a transport roller pair that nips and feeds the medium being transported between the first route member and the second route member and includes a first roller that comes into contact with the first surface of the medium and a second roller that comes into contact with the second surface of the medium; and a gate that is switchable between a first state and a second state, the first state being a state in which the gate closes the medium transport route at a location upstream, in a medium transport direction, of a nip location at which the transport roller pair nips the medium, the second state being a state in which the gate opens the medium transport route. The gate is disposed on a rotating member that is rotatable around a first rotating shaft, which is a rotating shaft for the first roller. The first rotating shaft engages with a fixed member. Both the first route member and the second route member are fixed to the fixed member.

With the first aspect, both of the first route member and the second route member are fixed to the fixed member. The fixed member engages with the first rotating shaft; the gate also engages with the first rotating shaft. Thus, the relative locations of the first route member, the second route member, and the gate are determined through the first rotating shaft. Consequently, the location of the gate relative to both the first route member and the second route member is accurately determined, so that a leading edge of the medium can be smoothly guided to the gate. This configuration can suppress the leading edge of the medium from coming into contact with the first roller or the second roller before the leading edge comes into contact with the gate, thereby correcting skew of the medium precisely.

According to a second aspect of the present disclosure which is dependent on the first aspect, both the first route member and the second route member may be fixed to the fixed member by inserting a screw in a direction along a straight line that passes through a rotational center of the first roller and a rotational center of the second roller as seen from a rotating shaft direction of the first roller or the second roller.

With the second aspect, both the first route member and the second route member may be fixed to the fixed member by inserting a screw in a direction along a straight line that passes through a rotational center of the first roller and a rotational center of the second roller. Consequently, the relative locations of the first route member, the second route member, and the gate may be accurately determined in the direction along the straight line.

According to a third aspect of the present disclosure which is dependent on the second aspect, both the first route member and the second route member may be fixed to the fixed member with the first route member positioned between the second route member and the fixed member.

With the third aspect, both the first route member and the second route member may be fixed to the fixed member with the first route member positioned between the second route member and the fixed member. Consequently, the location of the gate relative to the first route member may be accurately determined. This configuration may be able to suppress the leading edge of the medium from coming into contact with the first roller before the leading edge comes into contact with the gate. It should be noted that the third aspect may also be dependent on the first aspect, instead of the second aspect.

According to a fourth aspect of the present disclosure which is dependent on the third aspect, both the first route member and the second route member may be fixed to the fixed member at locations on both outer sides, in the rotating shaft direction of the first roller or the second roller, of a transport region in which the medium is to be transported.

With the fourth aspect, both the first route member and the second route member may be fixed to the fixed member at locations on both outer sides, in the rotating shaft direction of the first roller or the second roller, of a transport region in which the medium is to be transported. This configuration may be able to precisely maintain the parallelism between the first roller and each of the first route member and the second route member in the rotating shaft direction, thereby smoothly guiding the leading edge of the medium to the transport roller pair with the first route member and the second route member. It should be noted that the fourth aspect may also be dependent on the first or second aspect, instead of the third aspect.

According to a fifth aspect of the present disclosure which is dependent on the fourth aspect, a screw by which both the first route member and the second route member are fixed to the fixed member may be passed through respective screw insertion holes formed in the fixed member and the first route member and fitted into a screw fitting hole formed in the second route member.

Consider a configuration in which a first route member and a second route member are fixed by screws to a fixed member at locations on both outer sides of a transport region in the rotating shaft direction of a first roller or a second roller. If the first route member, the second route member, and the fixed member are all provided with screw fitting holes, some of these members might be deformed in the rotating shaft direction when the screw fitting holes are misaligned from one another. With the fifth aspect, however, the screw fitting hole may be formed only in the second route member, whereas the screw insertion holes may be formed in the fixed member and the first route member. This configuration may be able to suppress the first route member, the second route member, and the fixed member from being deformed even if the screw fitting hole is misaligned from each of the screw insertion holes.

According to a sixth aspect of the present disclosure which is dependent on the fifth aspect, the fixed member may include a first fixed member and a second fixed member, the first fixed member being disposed on a first outer side of both the outer sides of the transport region in the rotating shaft direction, the second fixed member being disposed on a second outer side of both the outer sides of the transport region in the rotating shaft direction. A first one of the first fixed member and the second route member may be provided with a first projection, and a second one of the first fixed member and the second route member may be provided with a first fitting hole into which the first projection is to be fitted. A first one of the second fixed member and the second route member may be provided with a second projection, and a second one of the second fixed member and the second route member may be provided with a second fitting hole into which the second projection is to be fitted. The first route member may be provided with a first insertion hole through which the first projection is to be passed and a second insertion hole through which the second projection is to be passed. A play between the second projection and the second insertion hole may be larger in the rotating shaft direction than a play between the first projection and the first insertion hole.

With the sixth aspect, by the screw fixing as well as by the first projection, the first insertion hole, and the first fitting hole, the relative locations of the first route member, the second route member, and the fixed member may be determined on the first outer side of the transport region in the rotating shaft direction. Likewise, by the screw fixing as well as by the second projection, the second insertion hole, and the second fitting hole, the relative locations of the first route member, the second route member, and the fixed member may be determined on the second outer side of the transport region in the rotating shaft direction. In this way, the relative locations of the first route member, the second route member, and the fixed member may be able to be accurately determined. Furthermore, dimension errors of the first route member and the second route member in the rotating shaft direction may be able to be absorbed because the play between the second projection and the second insertion hole may be larger in the rotating shaft direction than that between the first projection and the first insertion hole.

According to a seventh aspect of the present disclosure which is dependent on one of the first to sixth aspects, when the gate is in the first state, an entire area of the first roller which protrudes from the first route member may be positioned downstream of the gate in the medium transport direction, as seen from the rotating shaft direction of the first roller.

With the seventh aspect, when the gate is in the first state, an entire area of the first roller which protrudes from the first route member may be positioned downstream of the gate in the medium transport direction, as seen from the rotating shaft direction of the first roller. This configuration may be able to suppress the leading edge of the medium from coming into contact with the first roller at a location upstream of the gate even if the gate is somewhat displaced relative to the first route member.

According to an eighth aspect of the present disclosure which is dependent on one of the first to sixth aspects, when the gate is in the first state, an entire area of the second roller which protrudes from the second route member may be positioned downstream of the gate in the medium transport direction, as seen from the rotating shaft direction of the second roller.

With the eighth aspect, when the gate is in the first state, an entire area of the second roller which protrudes from the second route member may be positioned downstream of the gate in the medium transport direction, as seen from the rotating shaft direction of the second roller. This configuration may be able to suppress the leading edge of the medium from coming into contact with the second roller at a location upstream of the gate even if the gate is somewhat displaced relative to the second route member. It should be noted that the eighth aspect may also be dependent on the seventh aspect, instead of one of the first to sixth aspects.

According to a ninth aspect of the present disclosure which is dependent on one of the first to sixth aspects, when the gate is in the first state, a portion of the first roller may protrude from the first route member toward the second route member at a location upstream of the gate in the medium transport direction, as seen from the rotating shaft direction of the first roller. The portion of the first roller may be positioned so as not to come into contact with the medium being guided by the first route member between the first roller and the second roller.

With the ninth aspect, a portion of the first roller, more specifically, the portion protruding from the first route member toward the second route member may be positioned so as not to come into contact with the medium being guided by the first route member between the first roller and the second roller. This configuration may be able to suppress the leading edge of the medium from coming into contact with the first roller at a location upstream of the gate even if the gate is somewhat displaced relative to the first route member. It should be noted that the ninth aspect may also be dependent on the eighth aspect, instead of one of the first to sixth aspects.

According to a tenth aspect of the present disclosure which is dependent on one of the first to sixth aspects, when the gate is in the first state, a portion of the second roller may protrude from the second route member toward the first route member at a location upstream of the gate in the medium transport direction, as seen from the rotating shaft direction of the second roller. The portion of the second roller may be positioned so as not to come into contact with the medium being guided by the second route member between the first roller and the second roller.

With the tenth aspect, a portion of the second roller, more specifically, the portion protruding from the second route member toward the first route member may be positioned so as not to come into contact with the medium being guided by the second route member between the first roller and the second roller. This configuration may be able to suppress the leading edge of the medium from coming into contact with the second roller at a location upstream of the gate even if the gate is somewhat displaced relative to the second route member. It should be noted that the tenth aspect may also be dependent on the seventh or ninth aspect, instead of one of the first to sixth aspects.

According to an eleventh aspect of the present disclosure which is dependent on one of the first to sixth aspects, at least one of the first roller and the second roller may be a toothed roller.

If a leading edge of a medium comes into contact with a first roller or a second roller implemented by a toothed roller before coming into contact with a gate, the leading edge of the medium may be misaligned from the gate, in which case the medium transport apparatus might fail to correct skew of the medium precisely. With the functions and effects of the first aspect, however, the location of the gate relative to both the first route member and the second route member may be accurately determined. Consequently, the leading edge of the medium may appropriately come into contact with the gate, so that the medium transport apparatus may be able to correct skew of the medium precisely.

According to a twelfth aspect of the present disclosure, a medium processing apparatus includes: the medium transport apparatus according to the first aspect; and a processing section that processes a medium transported by the medium transport apparatus.

With the twelfth aspect, a medium processing apparatus that includes a processing section that processes a medium transported by the medium transport apparatus can provide substantially the same function and effect as the medium transport apparatus of the first aspect.

According to a thirteenth aspect of the present disclosure, a recording apparatus includes: the medium transport apparatus according to the eleventh aspect; a recording section that records information on a surface of a medium which is in contact with the second roller by discharging a liquid onto the surface; and a reverse route along which the medium on which the information was recorded by the recording section is to be turned over and fed to the medium transport apparatus. The first roller is the toothed roller.

With the thirteenth aspect, when the medium on a surface of which the information has been recorded by the recording section is turned over along the reverse route, the surface of the medium inevitably comes into contact with the first roller. In this case, the first roller, which is implemented by a toothed roller, can suppress transfer of the liquid.

Some embodiments of the present disclosure will be described below in detail. More specifically, a description will be given below of an ink jet printer 1, which is configured to record information on a medium P, such as a record sheet, by discharging ink or any other liquid onto the medium P. Hereinafter, the ink jet printer 1 may be referred to as the printer 1 for convenience. The printer 1 is an example of a recording apparatus. The printer 1 may also be referred to as a medium processing apparatus equipped with a processing section that processes a medium P. In this case, a line head 46 (described later) corresponds to an example of the processing section.

Each drawing employs an X-Y-Z coordinate system as an orthogonal coordinate system, in which the Y-axial directions correspond to directions (also referred to as medium width directions or apparatus depth directions) that intersect a transport direction of a medium P. The Y-axial directions also correspond to directions in which the rotating shafts of individual rollers (described later) extend. Of the Y-axial directions, one from the front to the rear of the printer 1 is defined as the +Y direction, and the other is defined as the −Y direction. The X-axial directions correspond to the width directions of the printer 1. Of the X-axial directions, the left direction with respect to an operator of the printer 1 is defined as the +X direction, and the right direction is defined as the −X direction. The Z-axial directions correspond to vertical directions, or apparatus height directions. Of the Z-axial directions, the upward direction is defined as the +Z direction, and the downward direction is defined as the −Z direction. Hereinafter, the direction in which a medium P is to be transported is sometimes defined as the downstream direction, whereas the opposite direction is sometimes defined as the upstream direction. In FIG. 1, the medium transport routes are indicated by the respective broken lines. The printer 1 transports a plurality of media P along the medium transport routes indicated by the broken lines.

Figure 3:
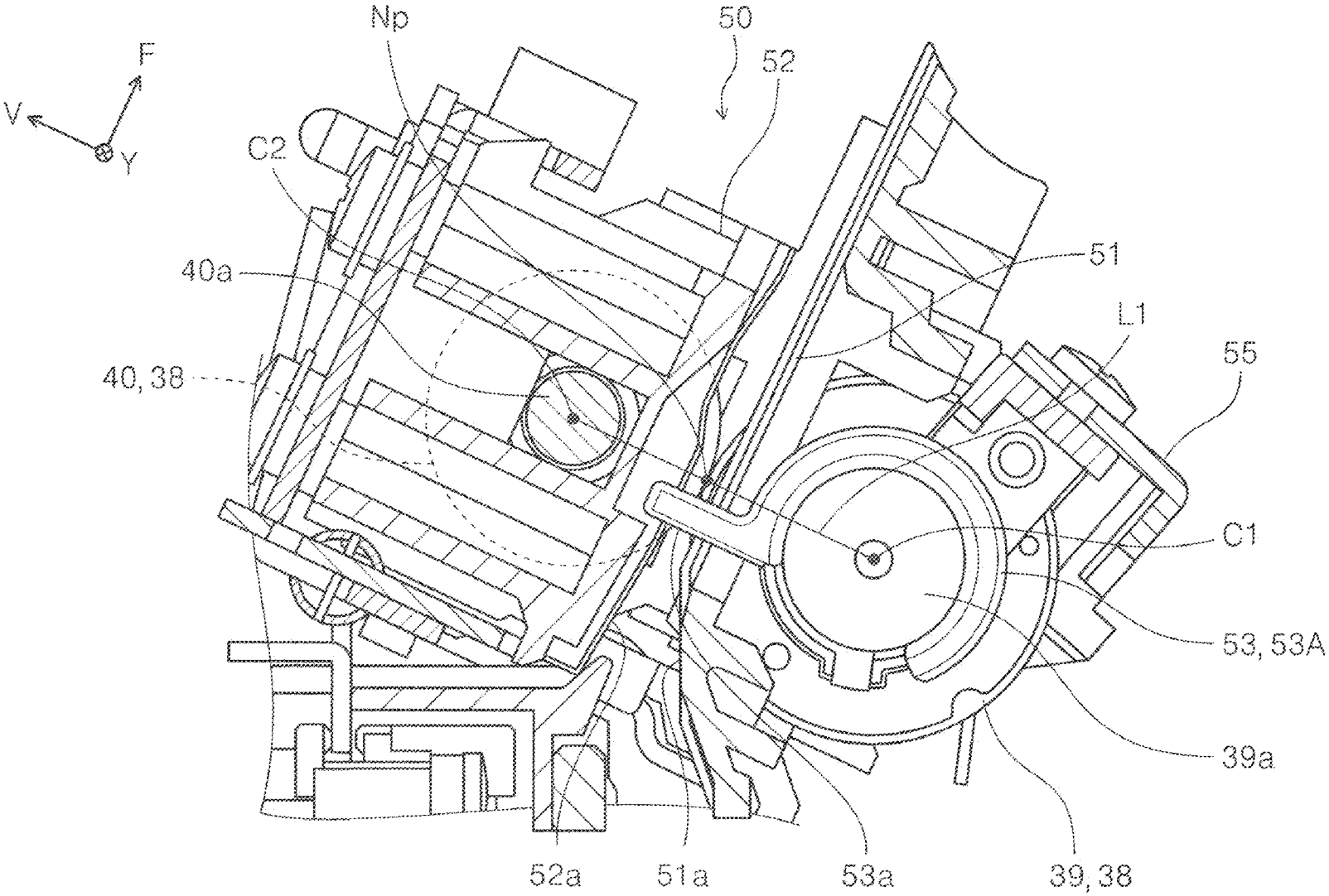
FIG. 3 is a side view of the medium transport apparatus in which gates are in a first state.

F-axial directions correspond to directions (medium transport direction) in which a medium P is to be transported between the line head 46 and a transport belt 13 (described later), or within a record region. Of the F-axial directions, the downstream one is defined as the +F direction, and the upstream one is defined as the −F direction. V-axial directions correspond to directions in which the head unit 45 moves. Of the V-axial directions, one in which the head unit 45 moves away from the transport belt 13 is defined as the +V direction, and the other, in which the head unit 45 moves toward the transport belt 13, is defined as the −V direction. FIG. 3 and the subsequent drawings illustrate the F-axial directions, the V-axial directions, and the Y-axial directions, or the Y-axial directions alone.

The printer 1 incudes: a main body 2; and a first medium cassette 3 disposed in a lower portion of the main body 2. The first medium cassette 3 accommodates a plurality of media P. In addition, an extension unit 6 is attachable to the lower side of the main body 2. When the extension unit 6 is attached to the printer 1, a second medium cassette 4 and a third medium cassette 5 are disposed below the first medium cassette 3. When fed from one of the first medium cassette 3, the second medium cassette 4, and the third medium cassette 5, a medium P is transported along a medium transport route indicated by a corresponding broken line inside the printer 1.

For each of the first medium cassette 3, the second medium cassette 4, and the third medium cassette 5, a pickup roller is disposed to feed a medium P accommodated therein in the −X direction. More specifically, a pickup roller 21 is disposed for the first medium cassette 3; a pickup roller 22 is disposed for the second medium cassette 4; and a pickup roller 23 is disposed for the third medium cassette 5. Furthermore, for each of the first medium cassette 3, the second medium cassette 4, and the third medium cassette 5, a feeding roller pair is disposed to obliquely upward feed the medium P that has been fed in the −X direction. More specifically, a feeding roller pair 25 is disposed for the first medium cassette 3; a feeding roller pair 26 is disposed for the second medium cassette 4; and a feeding roller pair 27 is disposed for the third medium cassette 5. The "roller pair" described herein refers to a pair of a drive roller to be driven by a motor (not illustrated) and a driven roller to be rotated by and together with the drive roller unless otherwise determined.

After having been fed from the third medium cassette 5, a medium P is further fed to a transport roller pair 35 by a transport roller pair 29 and a transport roller pair 28 in this order. Likewise, after having been fed from the second medium cassette 4, a medium P is further fed by a transport roller pair 28 to the transport roller pair 35. The medium P is then further fed by the transport roller pair 35 to a transport roller pair 38, which is one of components constituting a medium transport apparatus 50. Hereinafter, a portion of the medium transport route between the transport roller pair 35 and the transport roller pair 38 is referred to as a curved route T0, which is curved in a U shape as illustrated in FIG. 1 and along which the medium P is to be curled. The transport roller pair 35 includes a drive roller 36 to be driven by a motor (not illustrated) and a driven roller 37 to be rotated by and together with the drive roller 36. The transport roller pair 38 includes a plurality of drive rollers 39 to be driven by a motor (not illustrated) and a plurality of driven rollers 40 to be rotated by and together with the respective drive rollers 39. The drive rollers 39 correspond to an example of a first roller that comes into contact with a first surface of a medium P, whereas the driven rollers 40 correspond to an example of a second roller that comes into contact with a second surface of the medium P.

After having been fed from the first medium cassette 3, a medium P is further fed to the transport roller pair 38 without passing through the transport roller pair 35. The reference character T4 denotes a portion of the medium transport route between the first medium cassette 3 and the transport roller pair 38; this portion is referred to as an upper cassette feed route T4. Furthermore, a supply roller 19 and a separation roller 20 are disposed near the transport roller pair 35 and serve as a roller pair that feeds a medium P from a supply tray (not illustrated in FIG. 1).

By receiving feed force from the transport roller pair 38, the medium P is fed to the site between the line head 46 and the transport belt 13, which corresponds to an example of a recording section, or a recording site facing the line head 46. Hereinafter, a portion of the medium transport route between the transport roller pair 38 and a transport roller pair 30 is referred to as a recording transport route T1.

The line head 46, which is one of components constituting a head unit 45, records information on one or both surfaces of a medium P by discharging a liquid, such as ink, onto the medium P. The line head 46 may be an ink discharge head in which nozzles thereof through which ink is to be discharged are arranged over the width of a medium P and which records information on the entire width of the medium P without moving in the width directions. The line head 46, however, is not limited to such a type; alternatively, the line head 46 may be a type that is mounted in a carriage and that discharges ink while the carriage is moving in the width directions.

The head unit 45 is disposed so as to be movable toward or away from the recording transport route T1. More specifically, the head unit 45 is disposed so as to be moveable between the recording site and an escape site: the recording site corresponds to a place indicated by the solid line in FIG. 1; and an escape site corresponds to a place indicated by the alternate long and two short dashes line and denoted by the reference character 45-1 in FIG. 1 at which the head unit 45 is disposed farthest from the transport belt 13. When the head unit 45 is positioned at the escape site, the line head 46 can be maintained by a maintenance mechanism (not illustrated). In this embodiment, the head unit 45 is moveable in the V-axial directions along an inclination of an ejection tray 8. In addition, the head unit 45 is disposed upstream of the ejection tray 8 in a medium discharge direction and is moveable along the lower surface of the ejection tray 8.

The reference characters 12*a*, 12*b*, 12*c*, and 12*d* each denote an ink storage unit that contains ink. The ink contained in each of the ink storage units 12*a*, 12*b*, 12*c*, and 12*d* is supplied to the line head 46 through a tube (not illustrated) and then discharged therefrom. Each of the ink storage units 12*a*, 12*b*, 12*c*, and 12*d* is detachably mounted inside the main body 2. The reference character 11 denotes a waste liquid container that stores the ink, or waste liquid, discharged from the line head 46 to a flashing cap for the sake of maintenance.

The transport belt 13 is an endless belt hung around a pulley 14 and a pulley 15. At least one of the pulleys 14 and 15 is driven by a motor (not illustrated) to run the transport belt 13. The medium P is transported to the site facing the line head 46 while sucked onto a surface of the transport belt 13. In this case, the medium P may be sucked onto the transport belt 13 with a known mechanism, such as an air suction mechanism or an electrostatic suction mechanism.

The recording transport route T1 extends near the line head 46 while being formed at a predetermined angle with respect to a horizontal or vertical line. The recording transport route T1 is a member by which the medium P is to be transported in the upward direction, which contains the −X-directional component and the +Z-directional component in FIG. 1. This configuration of the recording transport route T1 contributes to the compactness of the printer 1 in a horizontal direction. In this embodiment, the recording transport route T1 may form an angle in the range from 65° to 85°, more specifically, an angle of approximately 750 with the horizontal line.

After the information has been recorded on a first surface of the medium P by the line head 46, the medium P is fed upward by the transport roller pair 30, which is disposed downstream of the transport belt 13. Then, a flap 41, which is disposed downstream of the transport roller pair 30, switches a medium transport route along which the medium P is to be transported. When the medium P is ejected from the printer 1, the flap 41 switches the medium transport route to a route leading to a transport roller pair 31 disposed above the flap 41. As a result, the medium P is ejected onto the ejection tray 8 by the transport roller pair 31.

When information is recorded on a second surface of the medium P, the flap 41 switches the medium transport route to a route leading to a branch location K1. The medium P then passes through the branch location K1 and is fed to a switchback route T2. In this embodiment, the switchback route T2 corresponds to a portion of the medium transport route above the branch location K1. The switchback route T2 is provided with a transport roller pair 32A and a transport roller pair 32B. After having been fed to the switchback route T2, the medium P is further fed upward by the transport roller pairs 32A and 32B in this order. After the trailing edge of the medium P has passed through the branch location K1, both the transport roller pairs 32A and 32B start to rotate in the opposite direction, thereby feeding the medium P downward.

The switchback route T2 is coupled to a reverse route T3. In this embodiment, the reverse route T3 corresponds to a route extending between the branch location K1 and the transport roller pair 38 in which a transport roller pair 33 and a transport roller pair 34 are disposed. In this case, the curved route T0 may be a portion of the reverse route T3. After having been fed downward from the branch location K1, the medium P receives feed force from the transport roller pairs 33 and 34 in this order. Due to this feed force, the medium P reaches the transport roller pair 35 and then is further fed by the transport roller pair 35 to the transport roller pair 38. Along the reverse route T3, the medium P is turned over so that the second surface of the medium P faces upward. The second surface refers to the surface that has been oriented downward during the recording, or the surface opposite to the first surface on which information has been recorded. The reference character 42 denotes another flap, which is disposed so as to be rotatable around a rotating shaft (not illustrated). The flap 42 is usually in a descending position and guides the medium P to the transport roller pair 35 along the reverse route T3. If fed from the second medium cassette 4 or the third medium cassette 5 disposed below the transport roller pair 35, the medium P reaches the transport roller pair 35 after having pushed up the flap 42.

When the medium P is fed to the site facing the line head 46 after having passed through the reverse route T3, the second surface of the medium P which is opposite to the first surface that first has faced the line head 46 then faces the line head 46. In this way, information can be recorded on both surfaces, or the first and second surfaces, of the medium P by the line head 46.

Figure 2:
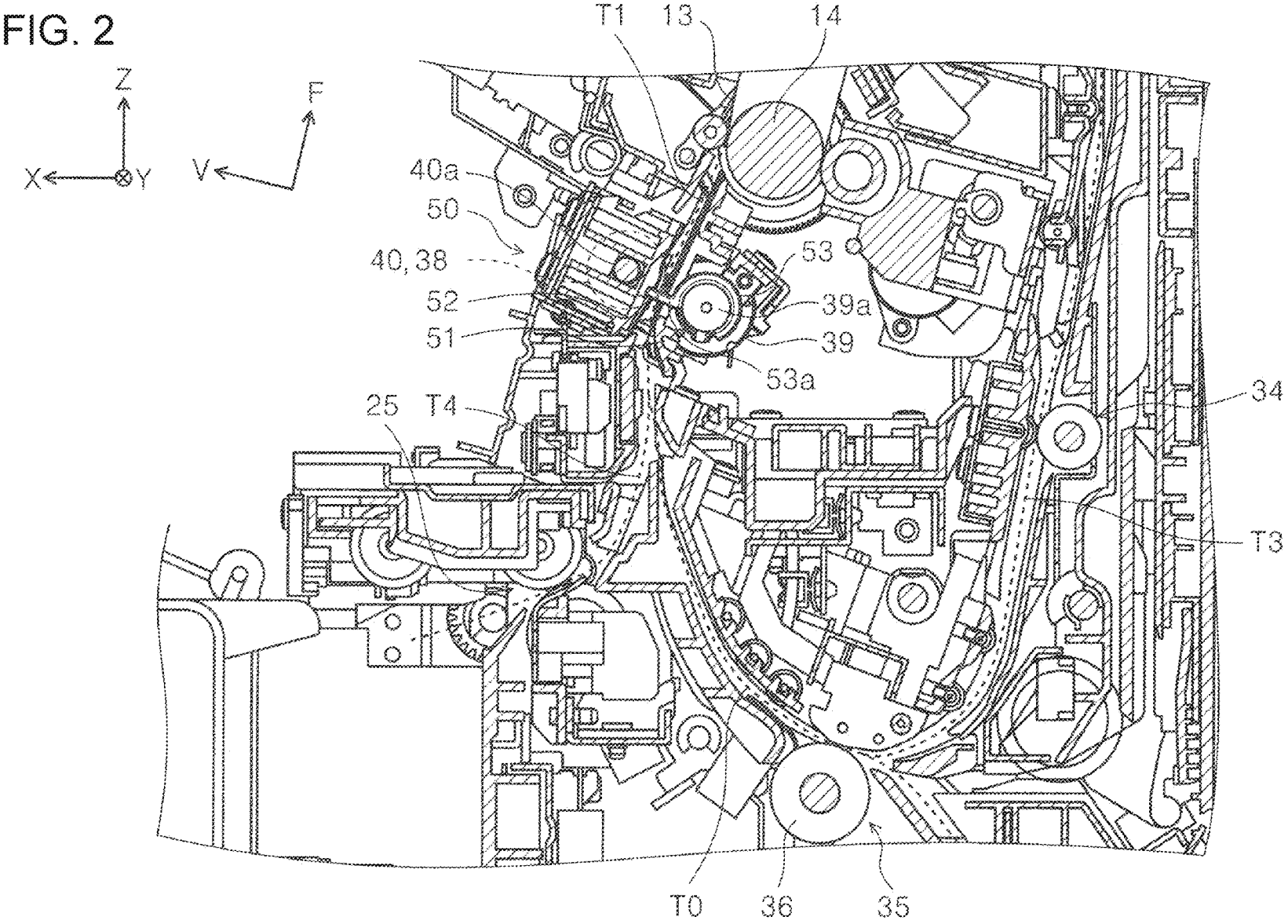
FIG. 2 illustrates a portion of the medium transport route in the printer.
Figure 5:
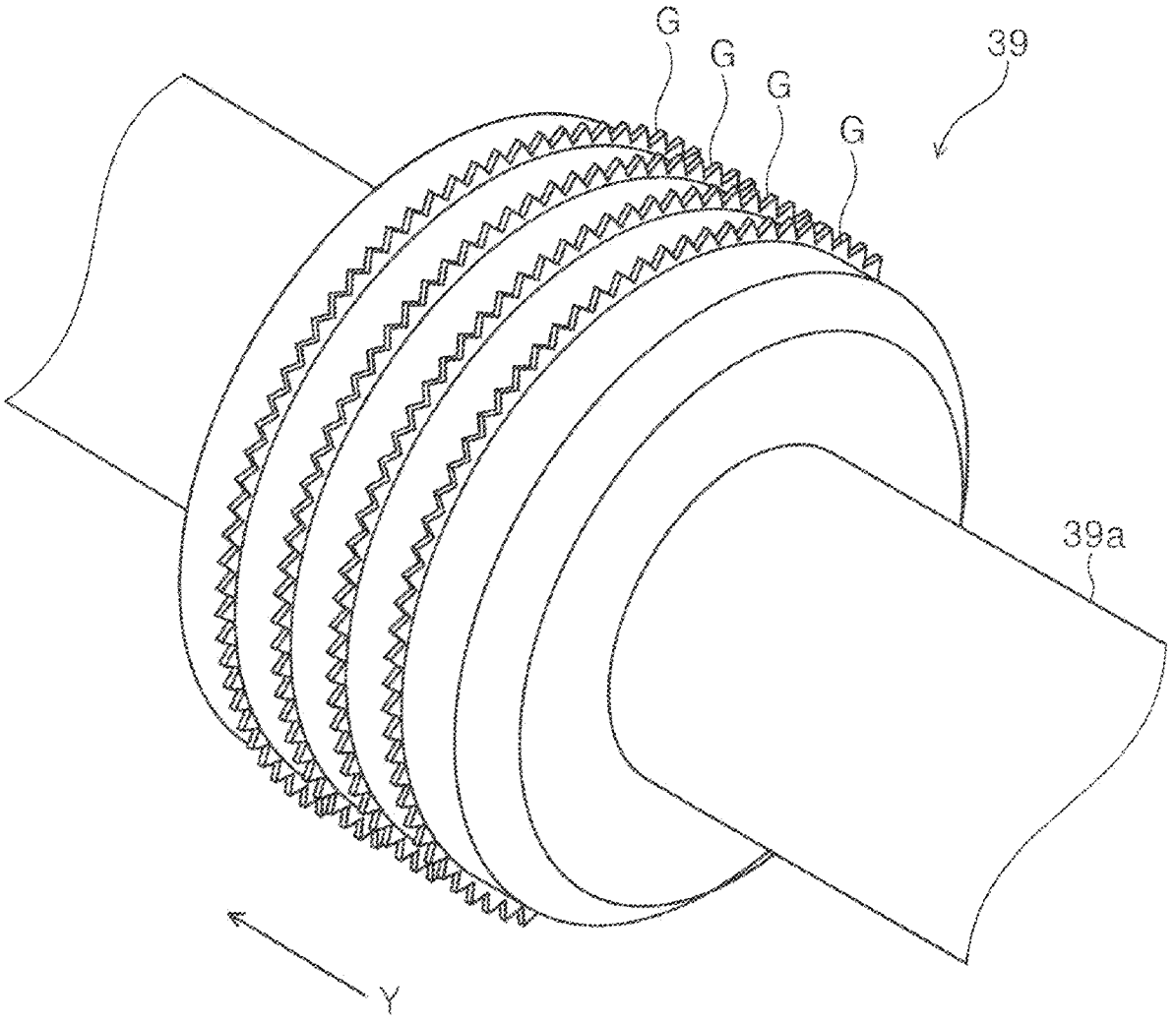
FIG. 5 is a perspective view of a drive roller in the medium transport apparatus.

With reference to FIG. 2, the medium transport apparatus 50 including the transport roller pair 38 will be described below in more detail. As illustrated in FIG. 2, the drive rollers 39 constituting the transport roller pair 38 are disposed on a first rotating shaft 39*a*. In this embodiment, each of the drive rollers 39 is a toothed roller having a plurality of teeth G on an outer circumference thereof, as illustrated in FIG. 5. In this embodiment, each of the driven rollers 40 disposed so as to face the drive roller 39 is a roller having no teeth G on an outer circumference thereof; however, each driven roller 40 may also be a toothed roller having a plurality of teeth G on an outer circumference thereof, similar to the drive rollers 39. Alternatively, each driven roller 40 may be a toothed roller having teeth G on an outer circumference thereof, whereas each drive roller 39 may be a roller having no teeth G on an outer circumference thereof, or all of the drive rollers 39 and the driven rollers 40 may have no teeth G on outer circumferences thereof.

As illustrated in FIG. 2, the first rotating shaft 39*a* is provided with a plurality of rotating members 53, which are disposed so as to be rotatable around the first rotating shaft 39*a* and each have a gate 53*a*. In this embodiment, the gates 53*a* are formed integrally with the respective rotating members 53; however, the gates 53*a* may be a plurality of independent members and attached to the rotating members 53. After having been fed along the curved route T0 or the upper cassette feed route T4, the medium P reaches the transport roller pair 38. Then, when a leading edge Pf (see FIG. 10) of the medium P comes into contact with the gates 53*a*, a portion of the medium P which is positioned upstream of the leading edge Pf becomes warped. As a result, the leading edge Pf becomes aligned with the ends of the gates 53*a*, so that the skew of the medium P is corrected.

The gates 53*a* can be switched between a first state (see FIGS. 2 and 3) and a second state (see FIG. 4) in response to the rotation of the rotating members 53. In the first state, the gate 53*a* closes the curved route T0 or the upper cassette feed route T4 at a location upstream, in the medium transport direction, of a nip location at which the transport roller pair 38 nips the medium P. In the second state, the gate 53*a* opens the curved route T0 or the upper cassette feed route T4. When the skew of the medium P is corrected, the gate 53*a* is switched to the first state; when the skew correction is completed, the gate 53*a* is switched to the second state. When being in the first state, the gates 53*a* only have to come into contact with the leading edge of the medium P at a location upstream of the nip location, at which the transport roller pair 38 nips the medium P. In FIG. 3, the gates 53*a* may be positioned so as to overlap a nip location Np at which the transport roller pair 38 nips the medium P. Switching the gates 53*a* between the first state and the second state is performed by a solenoid 65 (see FIG. 15), which is driven by a controller (not illustrated).

Figure 10:
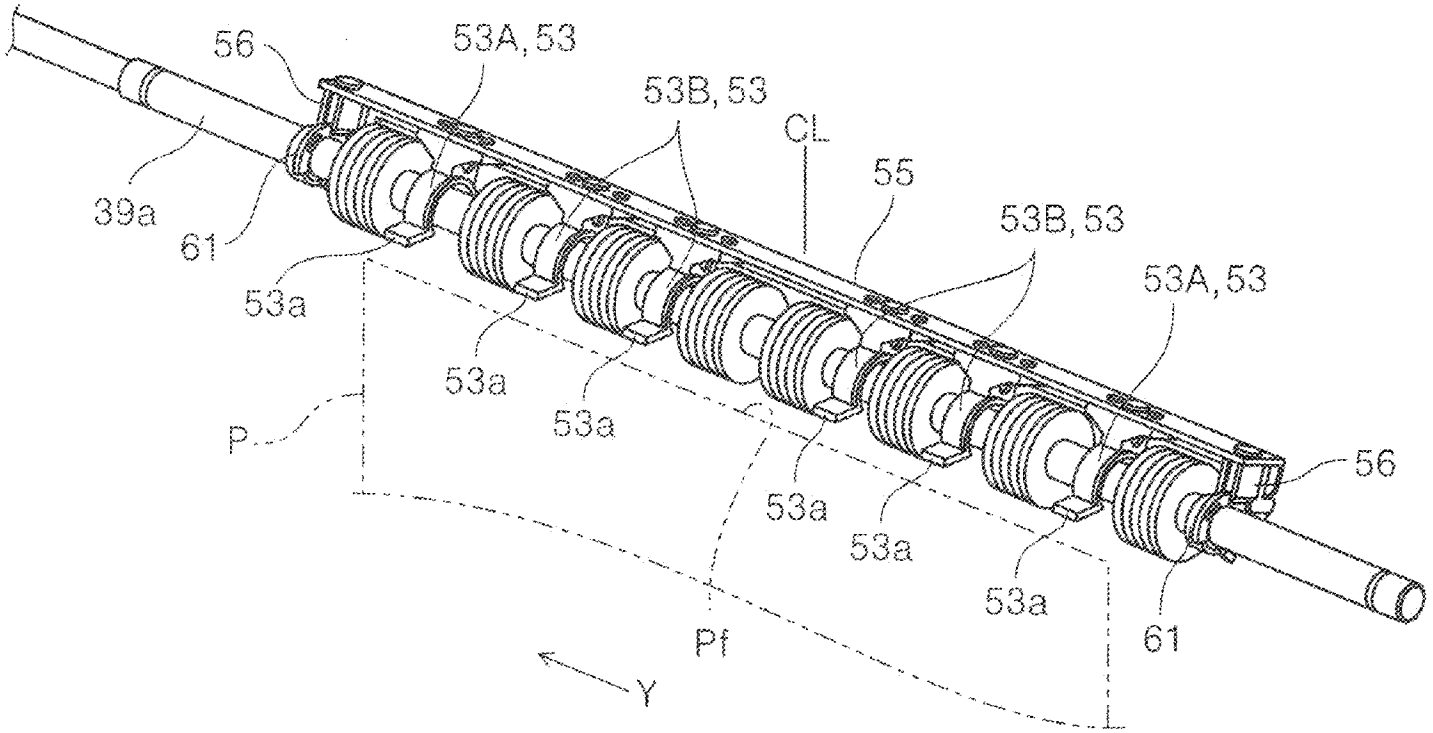
FIG. 10 is a perspective view of the gates in the first state, the drive roller, and the first rotating shaft.
Figure 11:
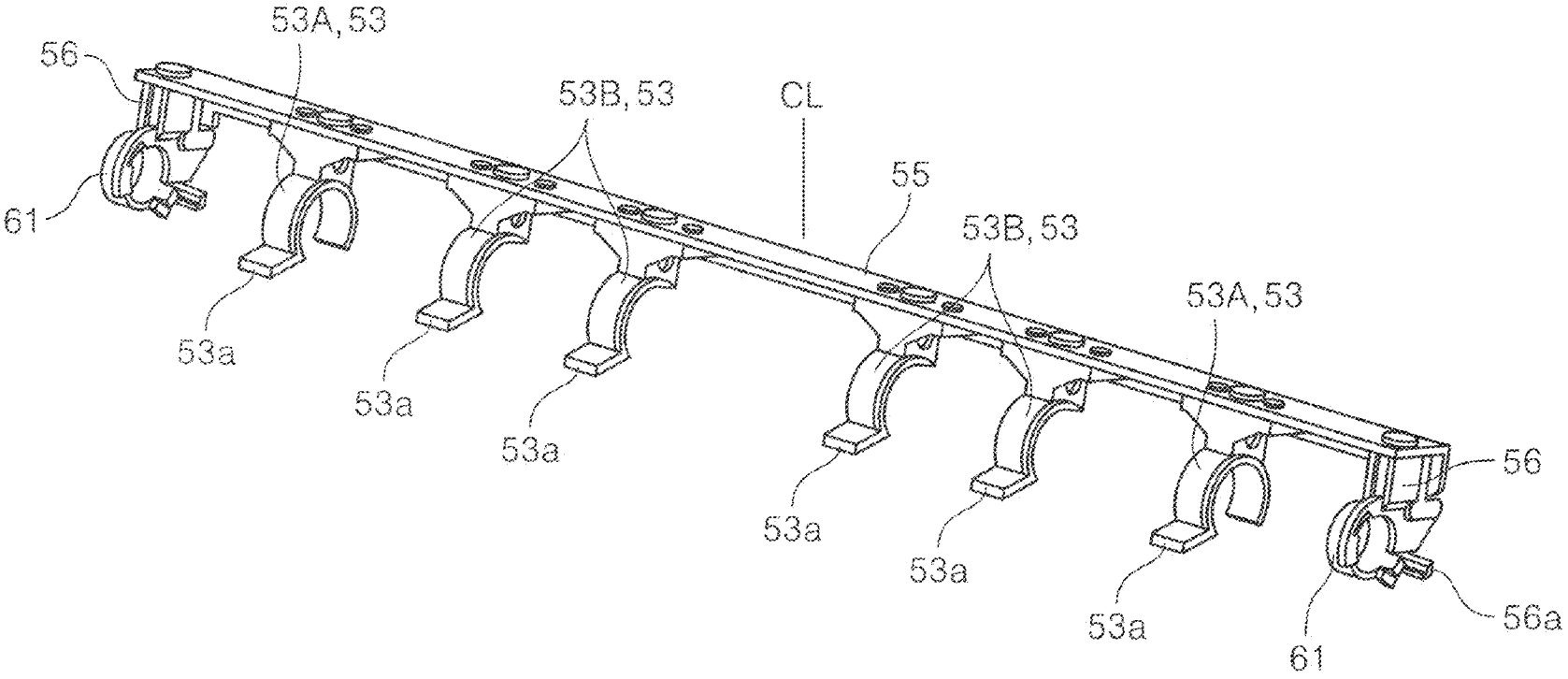
FIG. 11 is a perspective view of the rotating members and a joint member.

As illustrated in FIGS. 10 and 11, the rotating members 53 are disposed on the first rotating shaft 39*a* at predetermined intervals. In FIGS. 10 and 11, the reference character CL denotes a central location of the medium P along the width thereof. The rotating members 53 are arranged so as to be horizontally symmetric with respect to the central location CL. In this embodiment, three rotating members 53 are arranged on each of the right and left portions of the first rotating shaft 39*a* with respect to the central location CL. Hereinafter, one of the Y-axial directions may be referred to as a rotating shaft direction. In this embodiment, the one of the Y-axial directions coincides with the rotating shaft direction of the first rotating shaft 39*a*, the rotating shaft direction of the second rotating shaft 40*a* (see FIGS. 2 to 4), or a medium width direction. The first rotating shaft 39*a* corresponds to the rotating shaft around which the drive roller 39 rotates; the second rotating shaft 40*a* corresponds to the rotating shaft around which the driven roller 40 rotates. The rotating members 53 are mounted on a joint frame 55 so that all the rotating members 53 can rotate together.

In this embodiment, as illustrated in FIG. 11, the rotating members 53 include: two rotating members 53A disposed near both ends of the joint frame 55 in the rotating shaft direction; and a plurality of rotating members 53B disposed between the rotating members 53A. Each of the rotating members 53A has an inner circumferential area to be in contact with at least half of the entire outer circumferential area of the first rotating shaft 39*a* in the circumferential direction and allows the first rotating shaft 39A to pass therethrough. In addition, the inner diameter of each rotating member 53A is substantially the same as or slightly larger than the outer diameter of the first rotating shaft 39*a*. The rotating members 53A thus can rotate around the first rotating shaft 39*a* with the inner circumferential surfaces thereof kept in contact with the outer circumferential surface of the first rotating shaft 39*a*. Each of the rotating members 53B has an inner circumferential area to be in contact with less than half of the entire outer circumferential area of the first rotating shaft 39*a* in the circumferential direction and has a larger inner diameter than that of the rotating member 53A. The rotating members 53B thus can rotate around the first rotating shaft 39*a* with the inner circumferential surfaces thereof kept apart from or in slight contact with the outer circumferential surface of the first rotating shaft 39*a*.

With the above configuration, while the rotating members 53A and 53B are rotating together with the joint frame 55, the inner circumferential surfaces of the rotating members 53A, which are disposed near both ends of the joint frame 55 in the rotating shaft direction, are kept in contact with the outer circumferential surface of the first rotating shaft 39*a*. If all the rotating members 53 are rotating members 53A, the rotating members 53 might cause wrench during the rotation due to dimension errors thereof, thus failing to rotate smoothly. In this embodiment, however, some of the rotating members 53 which are disposed near both ends of the joint frame 55 in the rotating shaft direction are rotating members 53A, and only the rotating members 53A are configured to be in contact with the outer circumferential surface of the first rotating shaft 39*a*. Therefore, all the rotating members 53 can rotate smoothly. It should be noted that all the gates 53*a* attached to the rotating members 53A and 53B are designed so as to be disposed in substantially the same location in the medium transport direction, namely, so as to be arranged in a line as seen from the rotating shaft direction. Herein, the rotating members 53A and 53B are collectively referred to as the rotating members 53 if it is unnecessary to distinguish the rotating members 53A and 53B from each other.

Both ends of the joint frame 55 in the rotating shaft direction are provided with attachment members 56, each of which has a ground member 61. Each ground member 61, which may be made of a sintered metal, has a ring shape that allows the first rotating shaft 39*a* to pass therethrough. In addition, each ground member 61 is electrically coupled to the ground (not illustrated) for the purpose of discharging static electricity to the outside through the first rotating shaft 39*a*. In this case, the inner diameter of each ground member 61 is designed with some margin reserved for the outer diameter of the first rotating shaft 39*a*. Therefore, while the rotating members 53A and 53B and the ground member 61 are rotating together, the rotating members 53A are mainly kept in contact with the first rotating shaft 39*a*.

Figure 16:
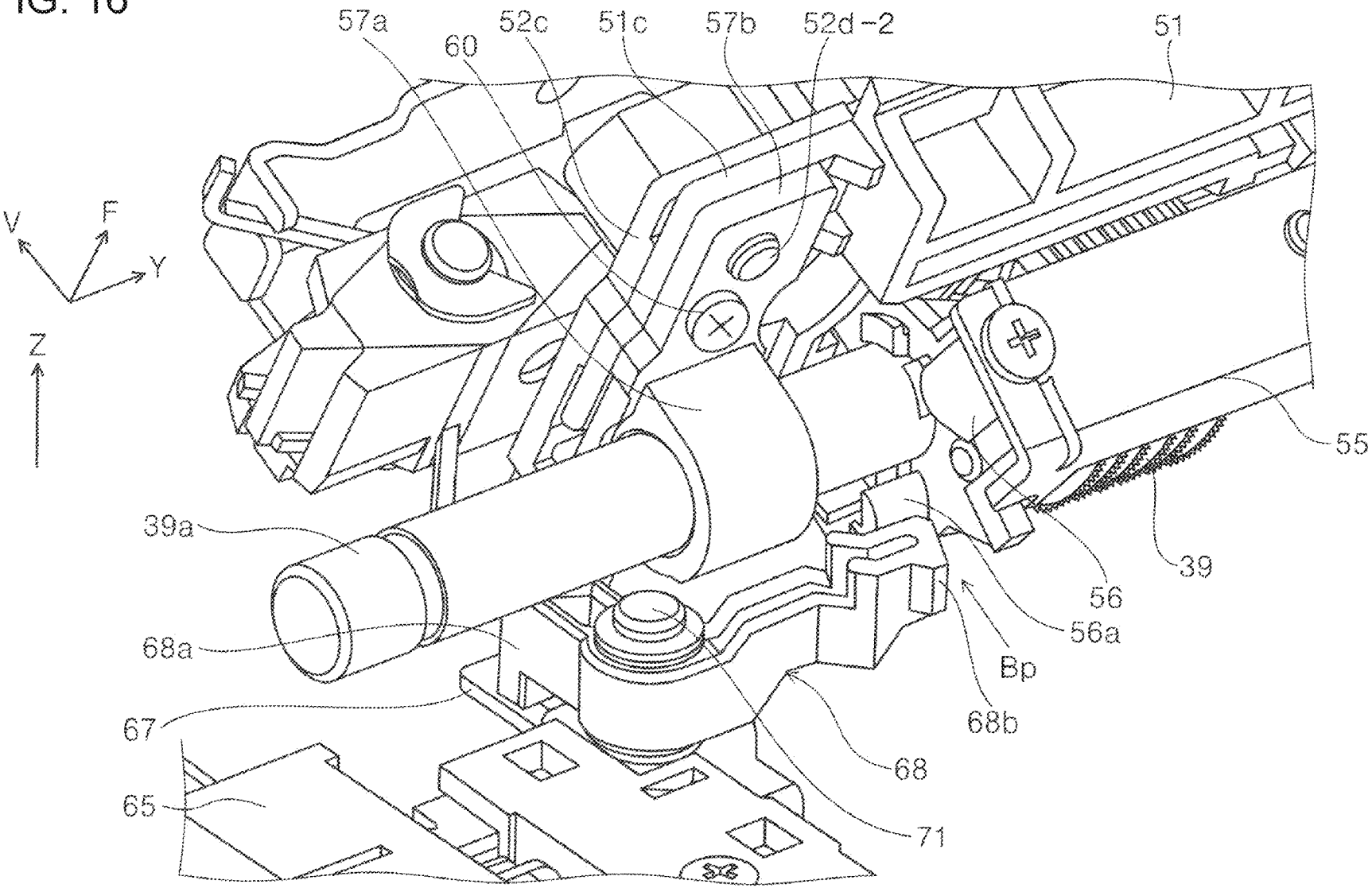
FIG. 16 is a perspective view of the medium transport apparatus and the rotating member when the gates are in the first state.

The −Y-side of each attachment member 56 is provided with a pressed section 56*a* protruding therefrom in the −Y direction. As illustrated in FIG. 16, a rotating cam 68 is disposed near the −Y-side end of the first rotating shaft 39*a*. When a corresponding pressed section 56*a* is pressed by the rotating cam 68 in the direction indicated by an arrow Bp, the rotating members 53 that have been in the state of FIG. 3 rotate clockwise, thereby switching the gate 53*a* from the first state to the second state. The joint frame 55 usually receives pressing force counterclockwise in FIG. 3 from a pressing member (not illustrated) such as a torsion spring. When the pressing force applied by the rotating cam 68 to the pressed section 56*a* is released, the rotating member 53 that has been in the state of FIG. 4 rotates counterclockwise in FIG. 4, thereby switching the gates 53*a* from the second state to the first state.

Figure 15:
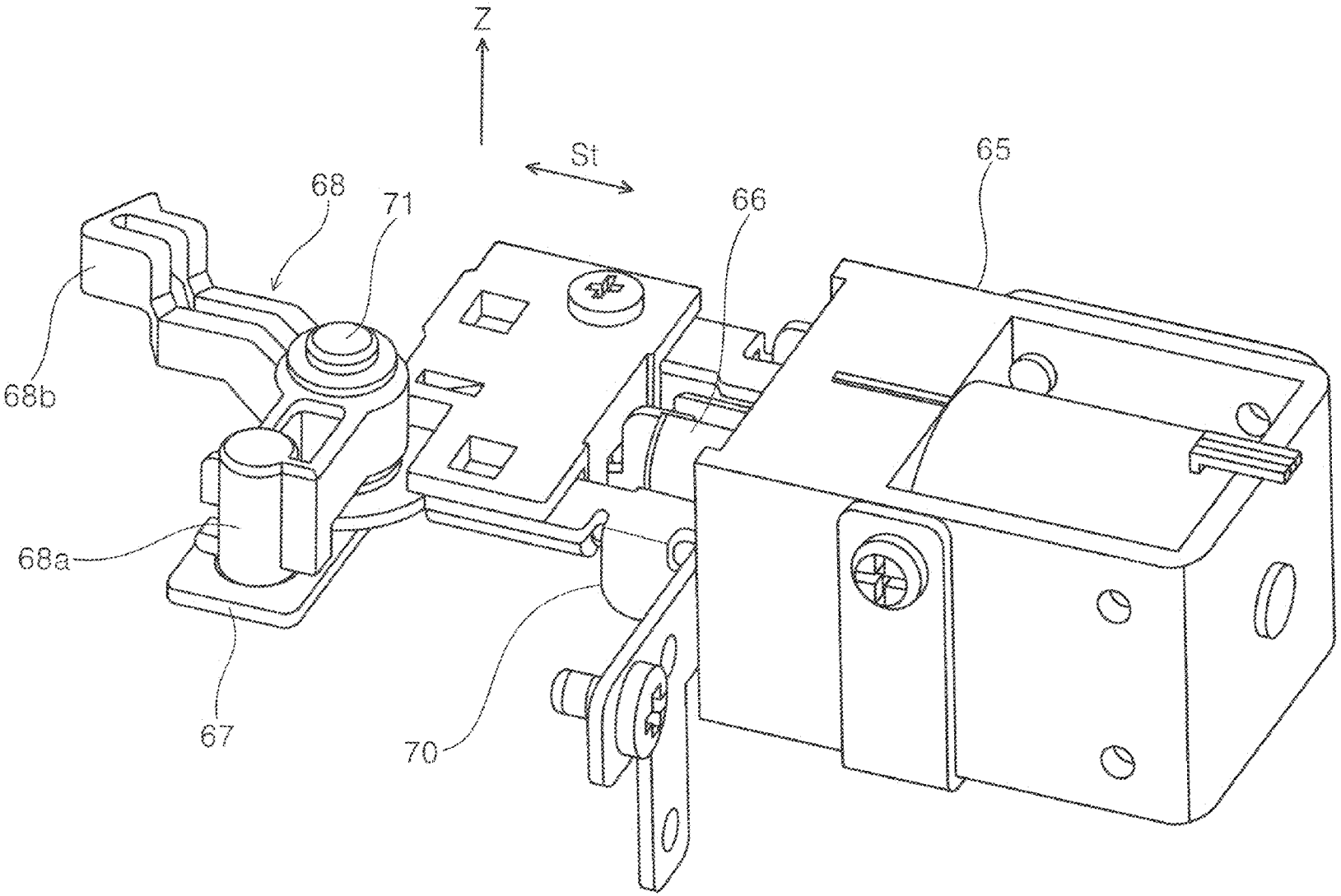
FIG. 15 is a perspective view of a solenoid and a rotating member that switches the gates between the first state and the second state.

As illustrated in FIGS. 15 and 16, the rotating cam 68 is disposed so as to be rotatable around a rotating shaft 71. In this embodiment, the rotating shaft 71 extends in the Z-axial directions. The rotating cam 68 includes a first engagement section 68*a* and a second engagement section 68*b*, both of which extend from the rotating shaft 71. The second engagement section 68*b* is a component that presses the pressed section 56*a*, whereas the first engagement section 68*a* is a component that engages with a coupling member 67. The coupling member 67, which is partly hidden in FIG. 15, is joined to a plunger 66 of the solenoid 65. The coupling member 67 is displaced in directions indicated by double arrows St in accordance with the displacement of the plunger 66 of the solenoid 65 in those directions. In response, the rotating cam 68 rotates around the rotating shaft 71. The rotating shaft 71 is mounted in an attaching frame 70; the solenoid 65 is also mounted in the attaching frame 70. However, the rotating members 53 may be rotated by any other mechanism. Alternatively, the rotating member 53 may be rotated by another actuator such as a motor or by virtue of the transport force transmitted from the medium P.

Figure 4:
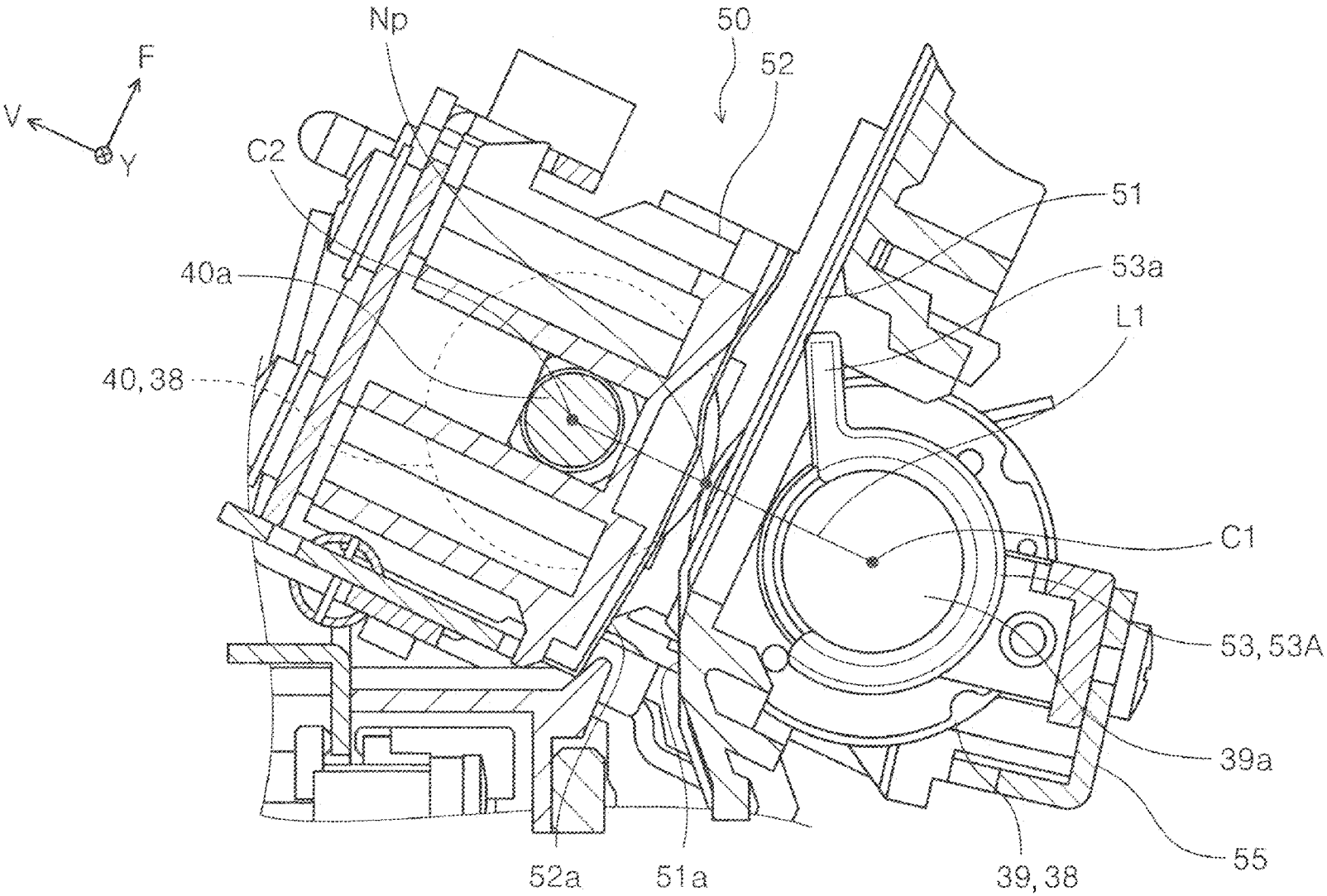
FIG. 4 is a side view of the medium transport apparatus in which the gates are in a second state.

With reference to FIGS. 2 to 4, a description will be given below of a first route member 51 and a second route member 52 included in the medium transport apparatus 50. The first route member 51 is disposed so as to face the first surface of the medium P, whereas the second route member 52 is disposed so as to face the second surface of the medium P. Both the first route member 51 and the second route member 52 constitute a portion of the medium transport route which leads to the transport roller pair 38. In this embodiment, both the first route member 51 and the second route member 52 constitute portions of the medium transport route which are positioned upstream and downstream, respectively, of the nip location Np, at which the transport roller pair 38 nips the medium P.

In FIGS. 3 and 4, the reference character C1 denotes a rotational center of each drive roller 39, whereas the reference character C2 denotes a rotational center of each driven roller 40, as seen from the rotating shaft direction. A straight line that passes through both the rotational centers C1 and C2 is defined as a straight line L1, on which the nip location Np is positioned. In FIGS. 3 and 4, the reference character 51*a* denotes a first route surface of the first route member 51 which is positioned upstream of the nip location Np and along which the leading edge of the medium P is to be guided to the nip location Np. Likewise, the reference character 52*a* denotes a second route surface of the second route member 52 which is positioned upstream of the nip location Np and along which the leading edge of the medium P is to be guided to the nip location Np. The portion of the medium transport route constituted by both the first route surface 51*a* and the second route surface 52*a* has a width that tapers toward the nip location Np.

Figure 6:
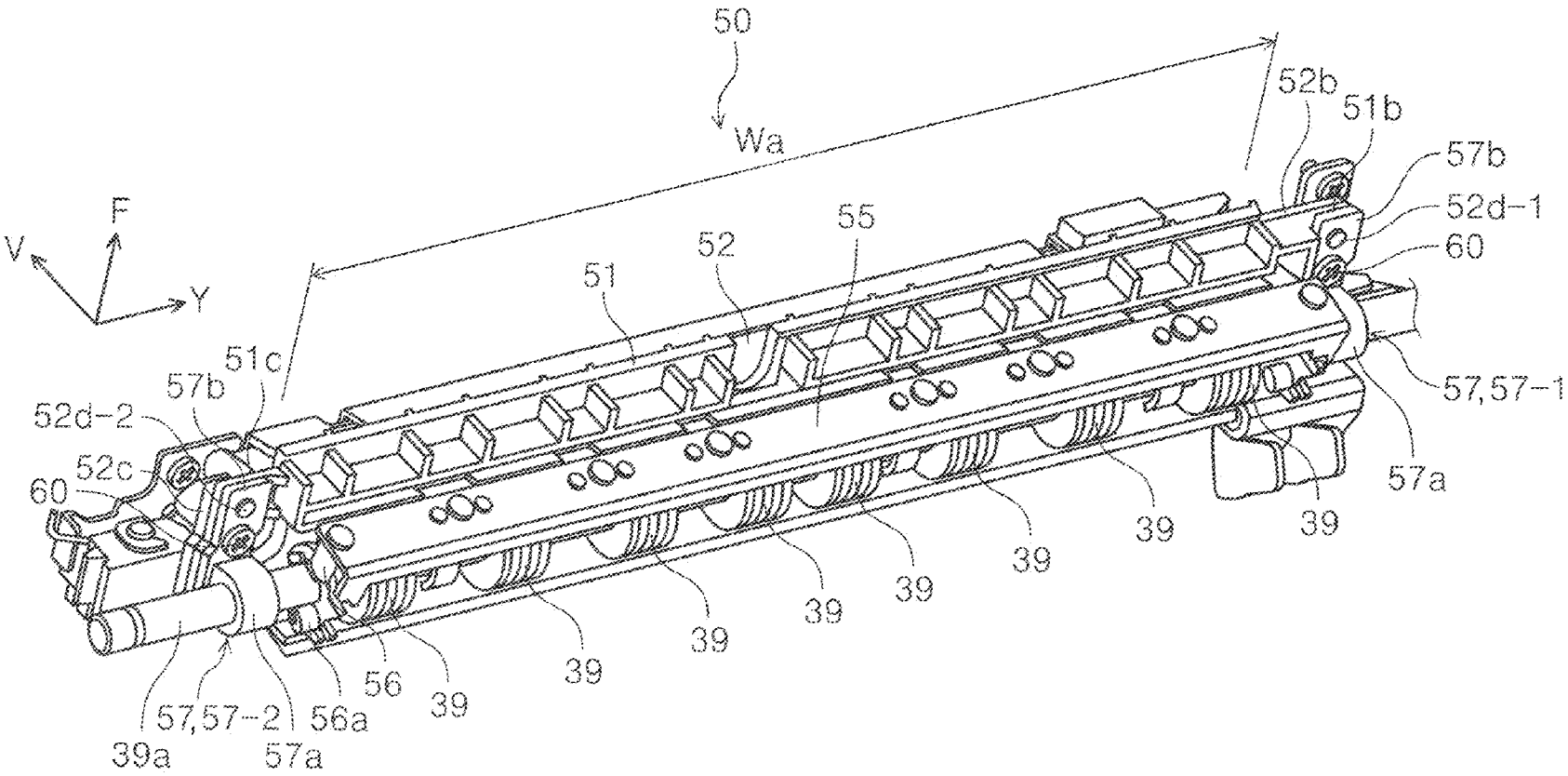
FIG. 6 is a perspective view of the medium transport apparatus in which the gates are in the first state.
Figure 7:
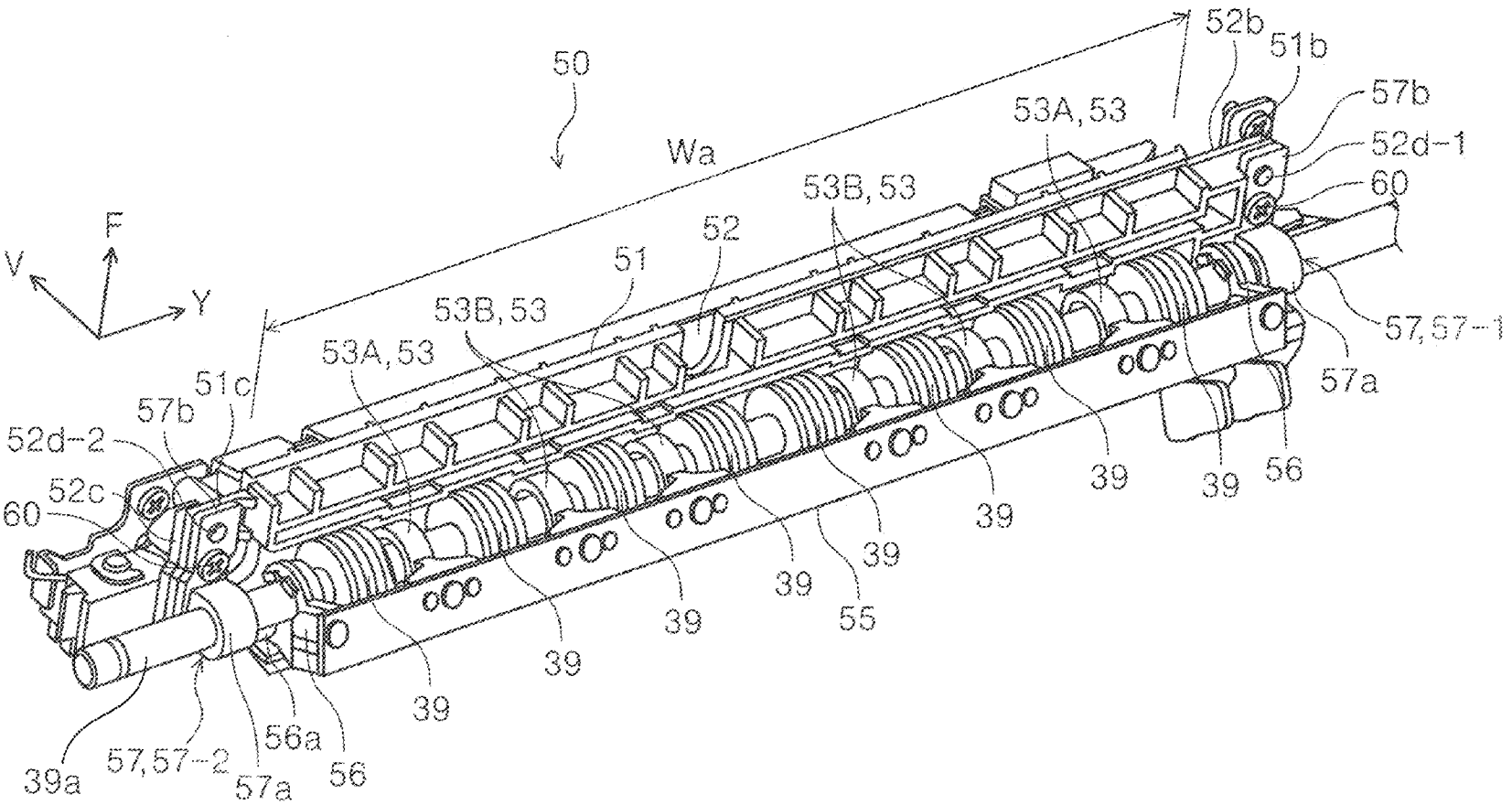
FIG. 7 is a perspective view of the medium transport apparatus in which the gates are in the second state.
Figure 8:
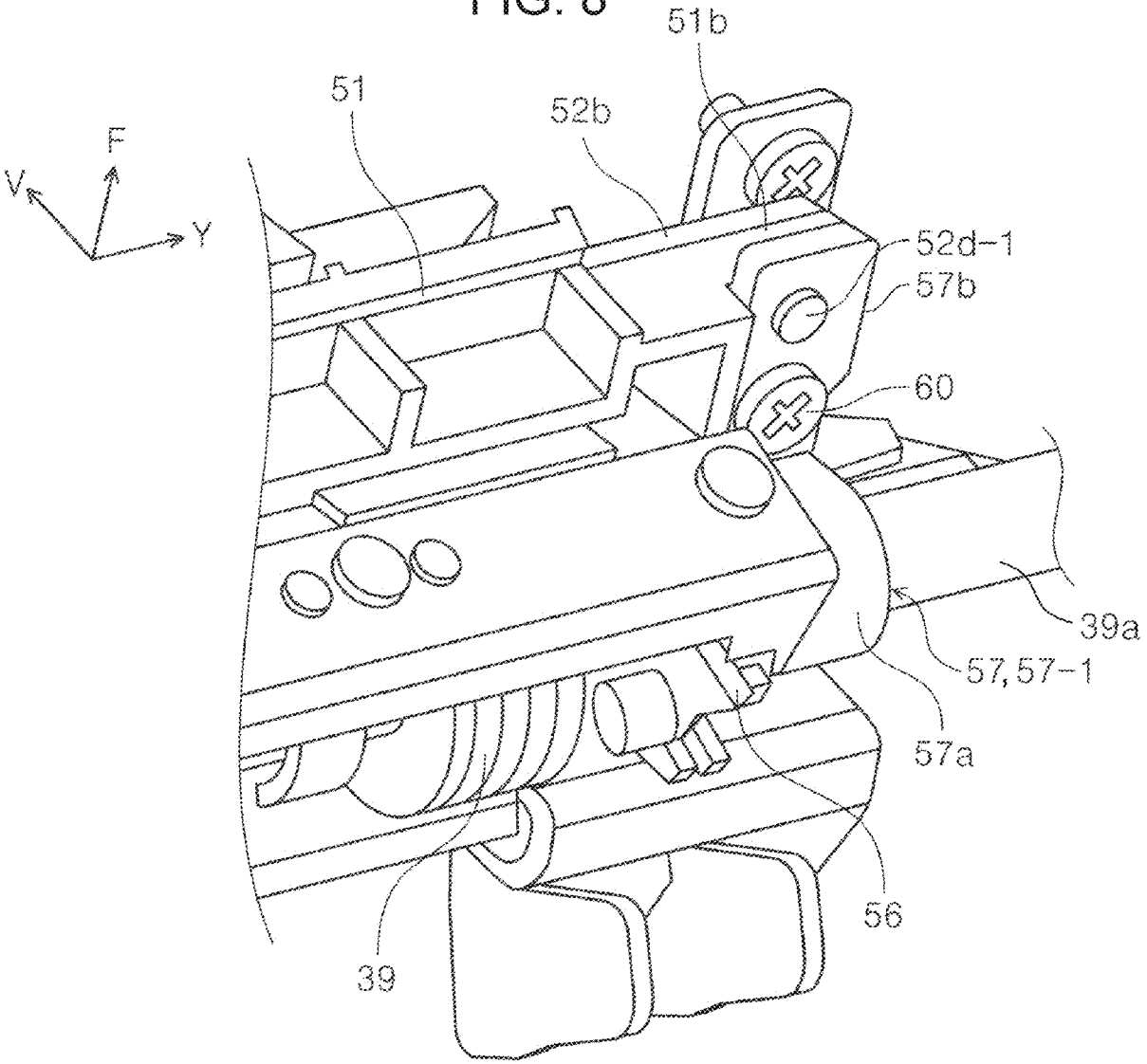
FIG. 8 is a partly enlarged perspective view of FIG. 6.
Figure 9:
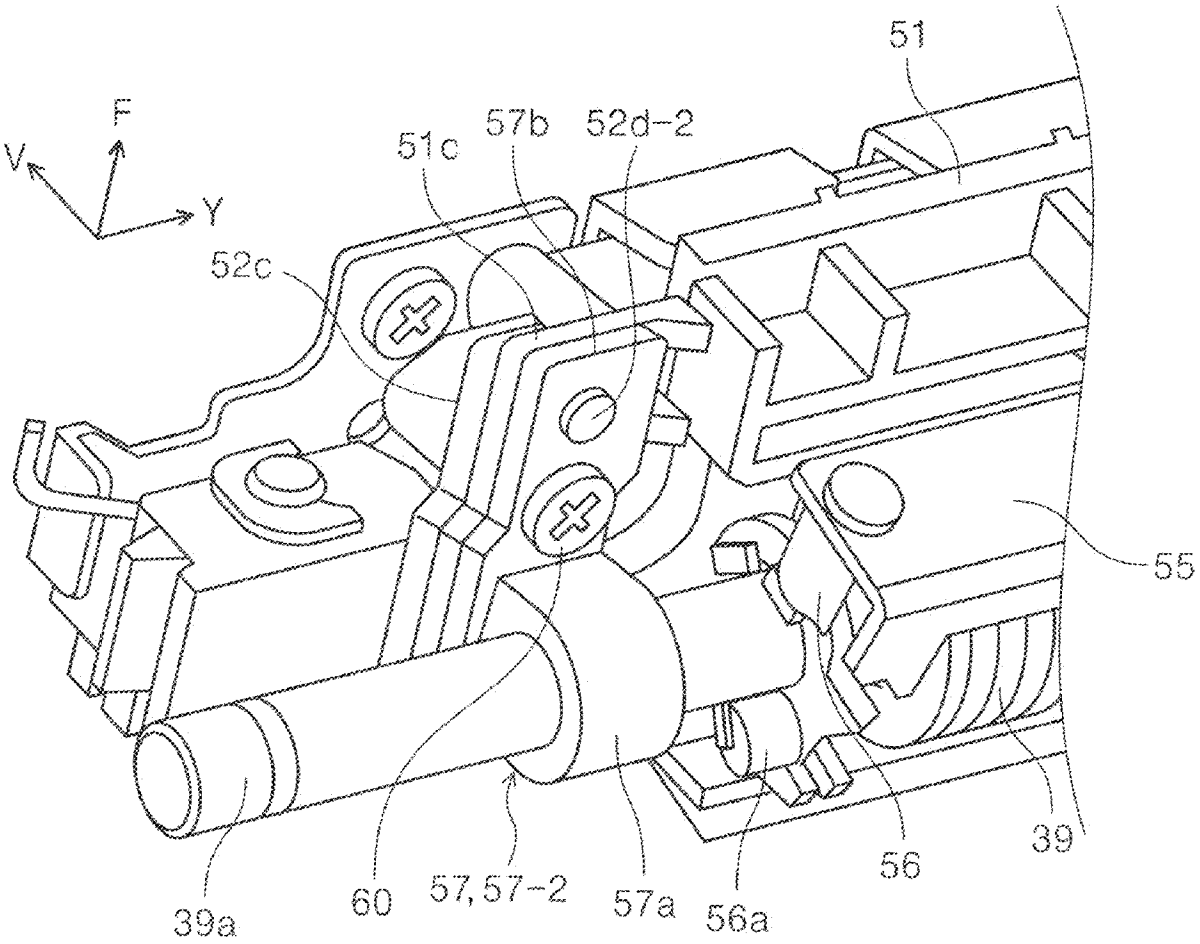
FIG. 9 is another partly enlarged perspective view of FIG. 6.
Figure 12:
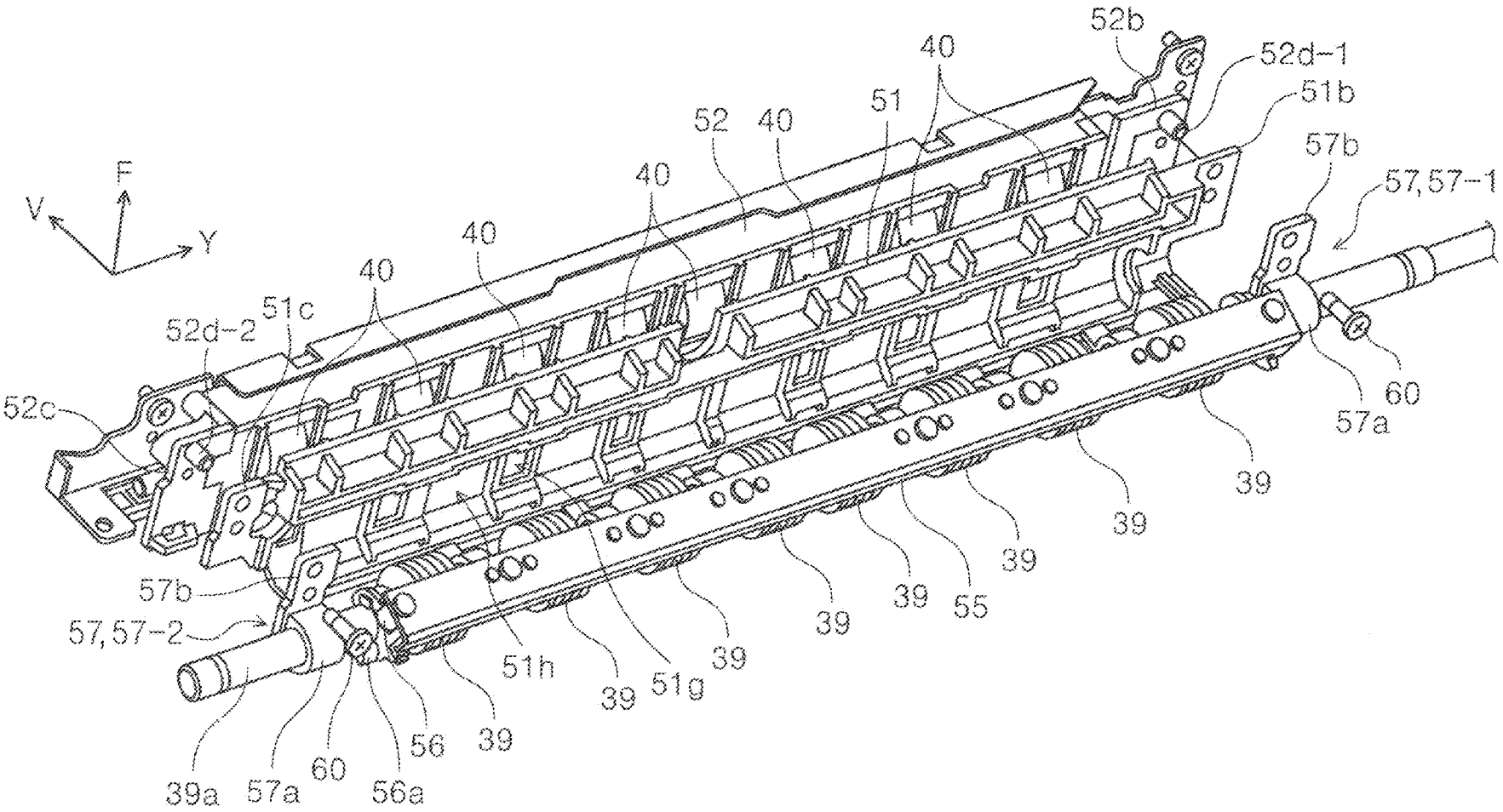
FIG. 12 is an exploded perspective view of the medium transport apparatus.

As can be found from FIGS. 6, 7, and 12, the lengths of the first route member 51 and the second route member 52 in the rotating shaft direction are much longer than those in the medium transport direction. As illustrated in FIG. 12, the first route member 51 has a plurality of apertures through which drive rollers 39 and the gates 53*a* are exposed toward the second route member 52. The reference character 51*h* denotes an aperture through which a corresponding drive roller 39 is exposed; the reference character 51*g* denotes an aperture through which a corresponding gate 53*a* is exposed. It should be noted that in FIG. 12, some of the apertures are not given reference characters for the sake of simplification. Likewise, the second route member 52 has a plurality of apertures through which driven rollers 40 are exposed toward the first route member 51.

The first route member 51 is provided with a right fixed section 51*b* at the +Y-side end and a left fixed section 51*c* at the −Y-side end in the rotating shaft direction. Each of the right fixed section 51*b* and the left fixed section 51*c* has a plate shape. Likewise, the second route member 52 is provided with a right fixed section 52*b* at the +Y-side end and a left fixed section 52*c* at the −Y-side end in the rotating shaft direction. Each of the right fixed section 52*b* and the left fixed section 52*c* has a plate shape.

The first rotating shaft 39*a* is provided with a plurality of fixed members 57 on respective outer sides, in the rotating shaft direction, of a transport region Wa (see FIGS. 6 and 7) in which the medium P is to be transported. Each of the fixed members 57 includes: a shaft insertion section 57*a* through which the first rotating shaft 39*a* passes; and a fixed section 57*b* having a plate shape. The shaft insertion section 57*a* is integrated with the corresponding fixed section 57*b*. As illustrated in FIGS. 6, 7, 8, and 9, each pair of the first route member 51 and the second route member 52 is fixed to the corresponding one of the fixed sections 57*b*. In this embodiment, two fixed members 57 are arranged on the first rotating shaft 39*a* in the Y-axial directions. Of the fixed members 57, one positioned at the +Y-side end is referred to as a first fixed member 57-1, and one positioned at the −Y-side end is referred to as a second fixed member 57-2. In this embodiment, the first fixed member 57-1 and the second fixed member 57-2 have substantially the same structure. Thus, the first fixed member 57-1 and the second fixed member 57-2 are collectively referred to as the fixed members 57 if it is unnecessary to distinguish the first fixed member 57-1 and the second fixed member 57-2 from each other.

Figure 13:
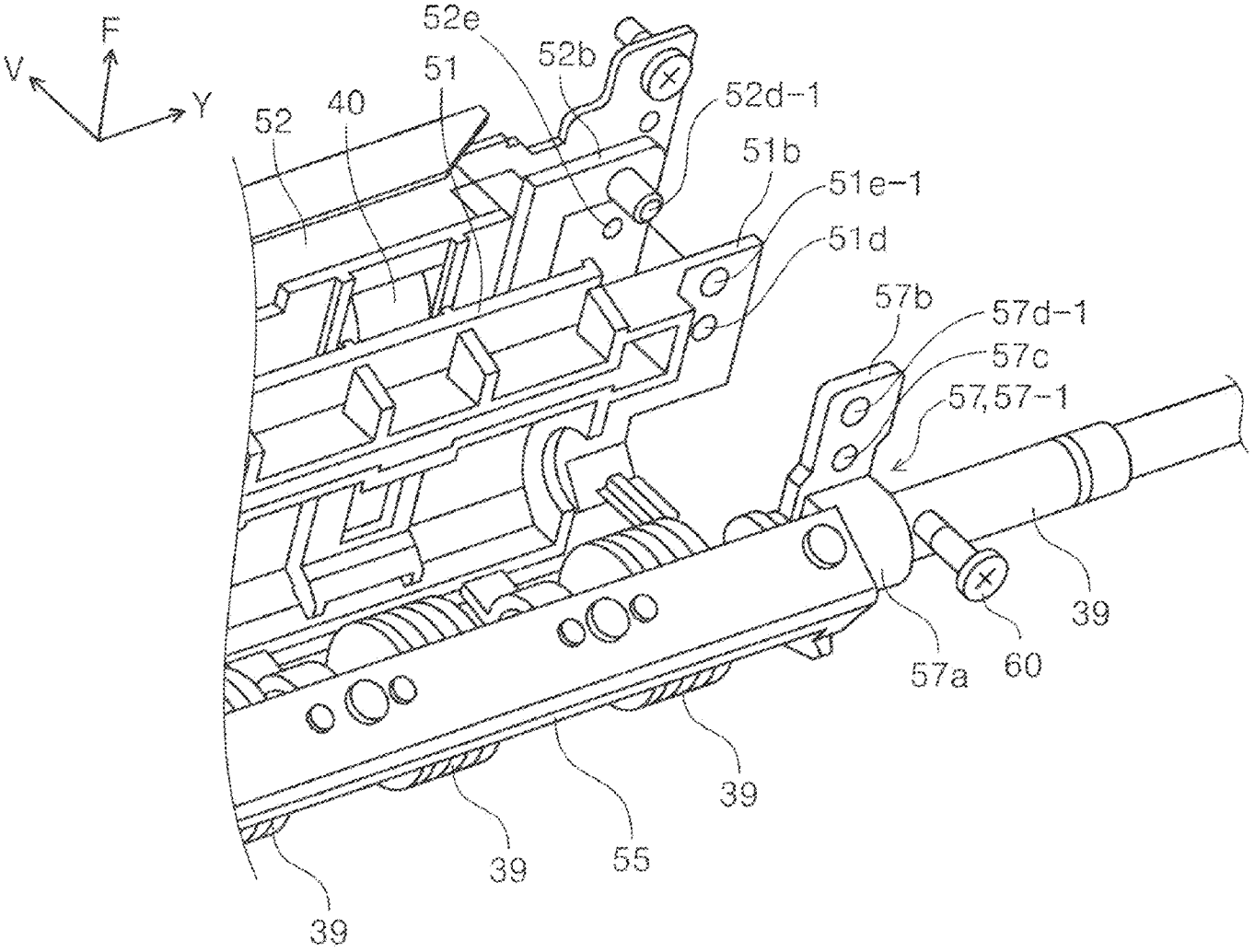
FIG. 13 is a partly enlarged perspective view of FIG. 12.

The first route member 51 and the second route member 52 will be described below in more detail. As illustrated in FIG. 13, which is an enlarged view of the portions of the first route member 51 and the second route member 52 on the +Y-side in FIG. 12, the fixed section 57*b* of the first fixed member 57-1 is provided with a screw insertion hole 57*c* and a first fitting hole 57*d*-1. The inner diameter of the screw insertion hole 57*c* is slightly larger than the outer diameter of a locking screw 60 (described later). The inner diameter of the first fitting hole 57*d*-1 is large enough to be able to removably fit a first projection 52*d*-1 (described later) having a cylindrical shape into the first fitting hole 57*d*-1 without rattling.

The right fixed section 51*b* of the first route member 51 is provided with a screw insertion hole 51*d* and a first insertion hole 51*e*-1. The inner diameter of the screw insertion hole 51*d* is slightly larger than the outer diameter of the locking screw 60. The inner diameter of the first insertion hole 51*e*-1 is large enough to be able to removably pass the first projection 52*d*-1 through the first fitting hole 57*d*-1 without rattling.

The right fixed section 52*b* of the second route member 52 is provided with a screw fitting hole 52*e* and the first projection 52*d*-1. The screw fitting hole 52*e* may be a threaded hole into which the locking screw 60 is to be screwed.

Both the right fixed section 51*b* of the first route member 51 and the right fixed section 52*b* of the second route member 52 can be fixed to the fixed section 57*b* of the first fixed member 57-1 (see FIG. 8) through the following steps: the locking screw 60 is passed through both the screw insertion hole 57*c* of the fixed section 57*b* and the screw insertion hole 51*d* of the first route member 51 with the right fixed section 51*b* of the first route member 51 disposed between the fixed section 57*b* of the first fixed member 57-1 and the right fixed section 52*b* of the second route member 52; and the locking screw 60 is screwed into the screw fitting hole 52*e* of the second route member 52. This step is referred to below as the screw fixing. In this state, the first projection 52*d*-1 of the second route member 52 is passed through the first insertion hole 51*e*-1 of the first route member 51 and fitted into the first fitting hole 57*d*-1 of the first fixed member 57-1. This fitting process is referred to below as the projection fitting. In this embodiment, the locking screw 60 is inserted into the screw fitting hole 52*e* in the direction along the straight line L1 illustrated in FIGS. 3 and 4.

In this embodiment, as described above, both the screw fixing and the projection fitting are employed. With the screw fixing, the relative locations of the right fixed section 51*b*, the right fixed section 52*b*, and the fixed section 57*b* in the V-axial directions are determined. With the projection fitting, the relative locations of the right fixed section 51*b*, the right fixed section 52*b*, and the fixed section 57*b* in the Y-axial directions and the F-axial directions are determined. The fixing method is, however, not limited to the combination of the screw fixing and the projection fitting; alternatively, only one of the screw fixing and the projection fitting may be employed. If the projection fitting is employed alone, the right fixed section 51*b* and the right fixed section 52*b* can be fixed to the fixed section 57*b* by press-fitting the first projection 52*d*-1 of the second route member 52 into the first fitting hole 57*d*-1 of the first fixed member 57-1.

Figure 14:
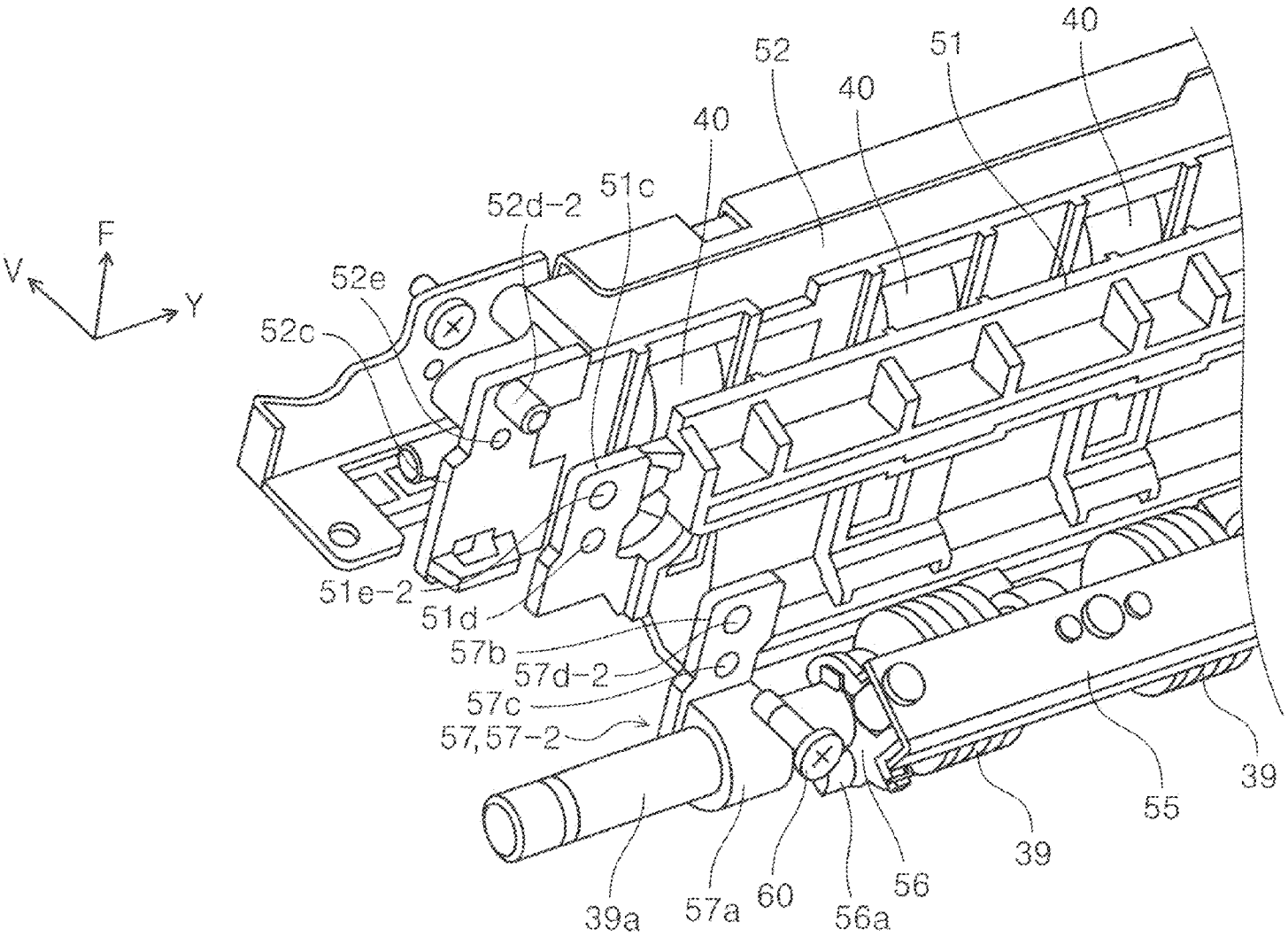
FIG. 14 is another partly enlarged perspective view of FIG. 12.

As illustrated in FIG. 14, which is an enlarged view of the components on the −Y-side in FIG. 12, the left fixed section 51*c* of the first route member 51 is provided with a screw insertion hole 51*d* and a second insertion hole 51*e*-2. The inner diameter of the screw insertion hole 51*d* is slightly larger than the outer diameter of a locking screw 60. Further, the inner diameter of the second insertion hole 51*e*-2 is slightly larger in the Y-axial directions than that of the first insertion hole 51*e*-1 described above. Thus, the second insertion hole 51*e*-2 does not have an out-of-round shape unlike the first insertion hole 51*e*-1; instead, the second insertion hole 51*e*-2 has an oval shape with the longer side thereof extending in the Y-axial directions. The left fixed section 52*c* of the second route member 52 is provided with a screw fitting hole 52*e* and a second projection 52*d*-2. The screw fitting hole 52*e* may be a threaded hole into which the locking screw 60 is to be screwed.

Both the left fixed section 51*c* of the first route member 51 and the left fixed section 52*c* of the second route member 52 can be fixed to the fixed section 57*b* of the second fixed member 57-2 (see FIG. 9) through the following steps: the locking screw 60 is passed through both the screw insertion hole 57*c* of the fixed section 57*b* and the screw insertion hole 51*d* of the first route member 51 with the left fixed section 51*c* of the first route member 51 disposed between the fixed section 57*b* of the second fixed member 57-2 and the left fixed section 52*c* of the second route member 52; and the locking screw 60 is fitted into the screw fitting hole 52*e* of the second route member 52. This step corresponds to the screw fixing. In this state, the second projection 52*d*-2 of the second route member 52 is passed through the second insertion hole 51*e*-2 of the first route member 51 and fitted into the second fitting hole 57*d*-2 of the second fixed member 57-2. This fitting process corresponds to the projection fitting.

The second insertion hole 51*e*-2 of the first route member 51 has an oval shape with the longer side thereof extending in the Y-axial directions, unlike the first insertion hole 51*e*-1 disposed on the opposite side in the rotating shaft direction. In this case, the play between the second projection 52*d*-2 and the second insertion hole 51*e*-2 is larger in the rotating shaft direction than that between the first projection 52*d*-1 and the first insertion hole 51*e*-1. This configuration enables the second projection 52*d*-2 to smoothly pass through the second insertion hole 51*e*-2 even if the first route member 51 and the second route member 52 are somewhat different in size in the longitudinal direction, namely, in the rotating shaft direction.

To fix the first route member 51 to the second route member 52 on the left side, both the screw fixing and the projection fitting are employed, similar to that on the right side. With the screw fixing, the relative locations of the left fixed section 51*c*, the left fixed section 52*c*, and the fixed section 57*b* in the V-axial directions are determined. With the projection fitting, the relative locations of the left fixed section 51*c*, the left fixed section 52*c*, and the fixed section 57*b* in the F-axial directions are determined. The fixing method is, however, not limited to the combination of the screw fixing and the projection fitting; alternatively, only one of the screw fixing and the projection fitting may be employed. If the projection fitting is employed alone, the left fixed section 51*c* and the left fixed section 52*c* are fixed to the fixed section 57*b* by press-fitting the second projection 52*d*-2 of the second route member 52 into the second fitting hole 57*d*-2 of the second fixed member 57-2.

Some functions and effects of a medium transport apparatus 50 according to an embodiment of the present disclosure will be described below. As described above, a medium transport apparatus 50 includes a gate 53*a* disposed on a rotating member 53, which is rotatable around a first rotating shaft 39*a*, the first rotating shaft 39*a* being a rotating shaft for a drive roller 39. The first rotating shaft 39*a* engages with a fixed member 57, which is fixed to a first route member 51 and a second route member 52. Thus, the relative locations of the first route member 51, the second route member 52, and the gate 53*a* are determined through the first rotating shaft 39*a*. Consequently, the location of the gate 53*a* relative to both the first route member 51 and the second route member 52 is accurately determined, so that a leading edge Pf of a medium P can be smoothly guided to the gate 53*a*. This configuration can suppress the leading edge Pf of the medium P from coming into contact with the drive roller 39 or a driven roller 40 before the leading edge Pf comes into contact with the gate 53*a*, thereby correcting skew of the medium P precisely. If the relative locations of a first route member 51, a second route member 52, and a gate 53*a* are poorly determined in a direction along the straight line L1 (see FIGS. 3 and 4), a drive roller 39 may excessively protrude from the first route member 51, or a driven roller 40 may excessively protrude from the second route member 52. In such cases, the leading edge Pf of the medium P might accidentally come into contact with the drive roller 39 or the driven roller 40 before the leading edge Pf comes into contact with the gate 53*a*. In this embodiment, however, the relative locations of the first route member 51, the second route member 52, and the gate 53*a* are accurately determined in the direction along the straight line L1. This configuration can suppress the leading edge Pf of the medium P from coming into contact with the drive rollers 39 or the driven rollers 40 before the leading edge Pf comes into contact with the gate 53*a*, thereby correcting skew of the medium P precisely. Moreover, the medium transport apparatus 50 can be handled as a single unit and mounted inside a main body 2 of a printer 1 at one time. Therefore, the medium transport apparatus 50 is effective in easily assembling the printer 1.

To suppress the leading edge Pf of the medium P from coming into contact with the drive roller 39 or the driven roller 40 before the leading edge Pf comes into contact with the gate 53*a*, it is only necessary to position the gate 53*a* at a location sufficiently upstream of the nip location Np between the drive roller 39 and the driven roller 40. However, it may be difficult to position the gate 53*a* sufficiently upstream of the nip location Np because the location of the gate 53*a* installed is restricted by, for example, the need to reserve the space in which the gate 53*a* is switched between the first state and the second state. Therefore, the configuration in which the relative locations of the first route member 51, the second route member 52, and the gate 53*a* are accurately determined can be effective.

Alternatively, the first route member 51 may be fixed to the fixed member 57, whereas the second route member 52 may be fixed to another member. This configuration can also accurately determine the relative positions of the first route member 51 and the gate 53*a*. Furthermore, in this embodiment, the drive roller 39 is driven by a motor, whereas the driven roller 40 is not driven by a motor. However, the driven roller 40 may be replaced with a drive roller to be driven by a motor. Alternatively, the drive roller 39 may be replaced with a driven roller not to be driven by a motor, whereas the driven roller 40 may be replaced with a drive roller to be driven by a motor. In this embodiment, the first route member 51 and the second route member 52 are separate components; however, the first route member 51 and the second route member 52 may be integrated together.

To fix both the first route member 51 and the second route member 52 to the fixed member 57, a locking screw 60 is inserted into the fixed member 57 in a direction along the straight line L1 (see FIGS. 3 and 4), which passes through a rotational center C1 of the drive roller 39 and a rotational center C2 of the driven roller 40. In this way, the relative locations of the first route member 51, the second route member 52, and the gate 53*a* can be accurately determined in the direction along the straight line L1. However, the insertion direction of the locking screw 60 is not limited to that along the straight line L1; it is obvious that the locking screw 60 may be inserted in any other direction. In addition, a method of fixing both the first route member 51 and the second route member 52 to the fixed member 57 is not limited to screw clamping. It is obvious that the method may also be press-fitting as described above as well as bonding, welding, snap-fitting, or any other suitable fixing method.

In this embodiment, both the first route member 51 and the second route member 52 are fixed to the fixed member 57 with the first route member 51 disposed between the second route member 52 and each fixed member 57. In this way, the relative locations of the first route member 51 and the gate 53*a* can be accurately determined. This configuration can suppress the leading edge Pf of the medium P from coming into contact with the drive rollers 39 before the leading edge Pf comes into contact with the gate 53*a*. In this embodiment, the first route member 51 is disposed between the second route member 52 and the fixed member 57; this configuration is referred to below as the first configuration. However, the second route member 52 may be disposed between the first route member 51 and the fixed member 57; this configuration is referred to below as the second configuration. With the second configuration, the relative locations of the second route member 52 and the gate 53*a* can also be accurately determined. This configuration can also suppress the leading edge Pf of the medium P from coming into contact with the driven roller 40 before the leading edge Pf comes into contact with the gate 53*a*. It may be selected as appropriate which of the first configuration and the second configuration is employed, depending on the location of a roller with which the leading edge Pf of the medium P may accidentally come into contact before the leading edge Pf comes into contact with the gate 53*a* or the location of a roller with which the leading edge Pf of the medium P more likely to come into contact than the gate 53*a*.

Each of the first route member 51 and the second route member 52 is fixed to the fixed member 57 at locations on both outer sides of a transport region Wa in the rotating shaft direction of the drive roller 39 or the driven roller 40. This configuration can precisely maintain the parallelism between the drive roller 39 and each of the first route member 51 and the second route member 52 in the rotating shaft direction, thereby smoothly guiding the leading edge Pf of the medium P to a transport roller pair 38 with the first route member 51 and the second route member 52.

To fix each of the first route member 51 and the second route member 52 to the fixed member 57 with the locking screw 60, the locking screw 60 is passed through a screw insertion hole 57*c* formed in the fixed member 57 and a screw insertion hole 51*d* formed in the first route member 51 and then fitted into a screw fitting hole 52*e* formed in the second route member 52. This configuration provides some functions and effects that will be described below. Consider a configuration in which a first route member 51 and a second route member 52 are fixed by screws to a fixed member 57 at locations on both outer sides of a transport region Wa in the rotating shaft direction of a drive roller 39 or a driven roller 40. If the first route member 51, the second route member 52, and the fixed member 57 are all provided with screw fitting holes, some of these members might be deformed in the rotating shaft direction when the screw fitting holes are misaligned from one another. In this embodiment, however, the screw fitting hole 52*e* is formed only in the second route member 52, whereas the screw insertion hole 57*c* is formed in the fixed member 57, and the screw insertion hole 51*d* is formed in the first route member 51. This configuration can suppress the first route member 51, the second route member 52, and the fixed member 57 from being deformed even if the screw fitting hole 52*e* is displaced from each of the screw insertion holes 57*c* and 51*d*.

The fixed member 57 includes: a first fixed member 57-1 disposed on a first outer side of both outer sides of the transport region Wa in the rotating shaft direction; and a second fixed member 57-2 disposed on a second outer side of both outer sides of the transport region Wa in the rotating shaft direction. The second route member 52 includes a right fixed section 52*b* provided with a first projection 52*d*-1, whereas the first fixed member 57-1 is provided with a first fitting hole 57*d*-1 into which the first projection 52*d*-1 is fitted. The second route member 52 further includes a left fixed section 52*c* provided with a second projection 52*d*-2, whereas the second fixed member 57-2 is provided with a second fitting hole 57*d*-2 into which the second projection 52*d*-2 is fitted. The first route member 51 includes a right fixed section 51*b* provided with a first insertion hole 51*e*-1 through which the first projection 52*d*-1 is passed. The first route member 51 further includes a left fixed section 51*c* provided with a second insertion hole 51*e*-2 through which the second projection 52*d*-2 is passed. Further, the play between the second projection 52*d*-2 and the second insertion hole 51*e*-2 is larger in the rotating shaft direction than that between the first projection 52*d*-1 and the first insertion hole 51*e*-1.

In the above configuration, by the screw fixing with the locking screw 60 as well as by the projection fitting with the first projection 52*d*-1, the first insertion hole 51*e*-1, and the first fitting hole 57*d*-1, the relative locations of the first route member 51, the second route member 52, and the first fixed member 57-1 are determined on the first outer side of the transport region Wa in the rotating shaft direction. Likewise, by the screw fixing with the locking screw 60 as well as by the projection fitting with the second projection 52*d*-2, the second insertion hole 51*e*-2, and the second fitting hole 57*d*-2, the relative locations of the first route member 51, the second route member 52, and the second fixed member 57-2 are determined on the second outer side of the transport region Wa in the rotating shaft direction. In this way, the relative locations of the first route member 51, the second route member 52, and the fixed member 57 can be accurately determined. Furthermore, dimension errors of the first route member 51 and the second route member 52 in the rotating shaft direction can be absorbed because the play between the second projection 52*d*-2 and the second insertion hole 51*e*-2 is larger in the rotating shaft direction than that between the first projection 52*d*-1 and the first insertion hole 51*e*-1. In this embodiment, the second route member 52 is provided with the first projection 52*d*-1 and the second projection 52*d*-2, the first fixed member 57-1 is provided with the first fitting hole 57*d*-1, and the second fixed member 57-2 is provided with the second fitting hole 57*d*-2. However, the fixed member 57 may be provided with a projection, and the second route member 52 may be provided with a fitting hole.

In this embodiment, when the gate 53*a* is in the first state as illustrated in FIG. 3, a portion of the drive roller 39 protrudes from the first route member 51 toward the second route member 52 at a location upstream of the gate 53*a* in the medium transport direction, as seen from the rotating shaft direction. However, the portion of the drive roller 39 does not come into contact with the medium P being guided by the first route member 51 between the drive roller 39 and the driven roller 40. This can be realized by the first route surface 51*a* of the first route member 51. This configuration can suppress the leading edge Pf of the medium P from coming into contact with the drive roller 39 at a location upstream of the gate 53*a* even if the gate 53*a* is somewhat displaced relative to the first route member 51.

In this embodiment, when the gate 53*a* is in the first state as illustrated in FIG. 3, a portion of the driven roller 40 protrudes from the second route member 52 toward the first route member 51 at a location upstream of the gate 53*a* in the medium transport direction, as seen from the rotating shaft direction. However, the portion of the driven roller 40 does not come into contact with the medium P being guided by the second route member 52 between the drive roller 39 and the driven roller 40. This can be realized by the second route surface 52*a* of the second route member 52. This configuration can suppress the leading edge Pf of the medium P from coming into contact with the driven roller 40 at a location upstream of the gate 53*a* even if the gate 53*a* is somewhat displaced relative to the second route member 52.

When the gate 53*a* is in the first state as illustrated in FIG. 3, the entirety of the drive roller 39 may be positioned downstream of the gate 53*a* in the medium transport direction, as seen from the rotating shaft direction. This configuration can suppress the leading edge Pf of the medium P from coming into contact with the drive roller 39 at a location upstream of the gate 53*a* even if the gate 53*a* is somewhat displaced relative to the first route member 51.

Likewise, when the gate 53*a* is in the first state as illustrated in FIG. 3, the entirety of the driven roller 40 may be positioned downstream of the gate 53*a* in the medium transport direction, as seen from the rotating shaft direction. This configuration can suppress the leading edge Pf of the medium P from coming into contact with the driven roller 40 at a location upstream of the gate 53*a* even if the gate 53*a* is somewhat displaced relative to the second route member 52.

In this embodiment, the drive roller 39 may be implemented by a toothed roller, which provides some functions and effects that will be described below. If the leading edge Pf of the medium P comes into contact with a drive roller 39 implemented by a toothed roller before coming into contact with a gate 53*a*, the leading edge Pf of the medium P may be misaligned from the gate 53*a*, in which case a medium transport apparatus 50 might fail to correct skew of the medium P precisely. In this embodiment, however, the relative locations of the first route member 51, the second route member 52, and the gate 53*a* are determined through the first rotating shaft 39*a*, as described above. Since the location of the gate 53*a* relative to the first route member 51 and the second route member 52 is accurately determined, the leading edge Pf of the medium P appropriately comes into contact with the gate 53*a*, so that the medium transport apparatus 50 can correct skew of the medium P precisely.

A printer 1 according to an embodiment of the present disclosure corresponds to an example of a medium processing apparatus that includes a processing section that processes a medium P transported by the above medium transport apparatus 50. A line head 46 in the printer 1 corresponds to an example of the processing section; however, the processing section is not limited to the line head 46. Instead of being the line head 46, the processing section may be a recording section that records information, such as an image, on a medium P, a processing section that performs a stable, punching or other similar process on a medium P, or a scanner that scans information, such as an image, on a medium P.

A printer 1 according to an embodiment of the present disclosure includes: a line head 46 that records information on a surface of a medium P being in contact with the driven roller 40 by discharging ink onto the surface; and a reverse route T3 along which the medium P on a surface of which the information has been recorded by the line head 46 is turned over and fed to the above medium transport apparatus 50. In this configuration, the drive roller 39 is implemented by a toothed roller. When the medium P on a surface of which the information has been recorded by the line head 46 is turned over along the reverse route T3, the surface of the medium P comes into contact with the drive roller 39. In this case, the drive roller 39, which is implemented by a toothed roller, can suppress transfer of the ink.

The foregoing embodiment is not intended to limit the present disclosure and thus can undergo various modifications, variations, and replacements within the scope of the claims described herein. It is obvious that such modifications, variations, and replacements also fall within the scope.

What is claimed is:

1. A medium transport apparatus comprising:

a first route member disposed so as to face a first surface of a medium;

a second route member disposed so as to face a second surface of the medium, the second surface being opposite to the first surface, both the first route member and the second route member constituting a medium transport route therebetween;

a transport roller pair that nips and feeds the medium being transported between the first route member and the second route member, the transport roller pair including a first roller that comes into contact with the first surface of the medium and a second roller that comes into contact with the second surface of the medium; and a gate that is switchable between a first state and a second state, the first state being a state in which the gate closes the medium transport route at a location upstream, in a medium transport direction, of a nip location at which the transport roller pair nips the medium, the second state being a state in which the gate opens the medium transport route, wherein the gate is disposed on a rotating member, the rotating member being rotatable around a first rotating shaft, the first rotating shaft being a rotating shaft for the first roller, the first rotating shaft engages with a fixed member, both the first route member and the second route member are fixed to the fixed member, and both the first route member and the second route member are fixed to the fixed member by inserting a screw in a direction along a straight line that passes through a rotational center of the first roller and a rotational center of the second roller as seen from a rotating shaft direction of the first roller or the second roller.

2. The medium transport apparatus according to claim 1, wherein both the first route member and the second route member are fixed to the fixed member with the first route member positioned between the second route member and the fixed member.

3. The medium transport apparatus according to claim 2, wherein both the first route member and the second route member are fixed to the fixed member at locations on both outer sides, in the rotating shaft direction of the first roller or the second roller, of a transport region in which the medium is to be transported.

4. The medium transport apparatus according to claim 3, wherein a screw by which both the first route member and the second route member are fixed to the fixed member is passed through respective screw insertion holes formed in the fixed member and the first route member and fitted into a screw fitting hole formed in the second route member.

5. The medium transport apparatus according to claim 4, wherein the fixed member includes a first fixed member and a second fixed member, the first fixed member being disposed on a first outer side of both the outer sides of the transport region in the rotating shaft direction, the second fixed member being disposed on a second outer side of both the outer sides of the transport region in the rotating shaft direction, a first one of the first fixed member and the second route member is provided with a first projection, and a second one of the first fixed member and the second route member is provided with a first fitting hole into which the first projection is to be fitted, a first one of the second fixed member and the second route member is provided with a second projection, and a second one of the second fixed member and the second route member is provided with a second fitting hole into which the second projection is to be fitted, the first route member is provided with a first insertion hole through which the first projection is to be passed and a second insertion hole through which the second projection is to be passed, and a play between the second projection and the second insertion hole is larger in the rotating shaft direction than a play between the first projection and the first insertion hole.

6. The medium transport apparatus according to claim 1, wherein when the gate is in the first state, an entire area of the first roller which protrudes from the first route member is positioned downstream of the gate in the medium transport direction, as seen from the rotating shaft direction of the first roller.

7. The medium transport apparatus according to claim 1, wherein when the gate is in the first state, an entire area of the second roller which protrudes from the second route member is positioned downstream of the gate in the medium transport direction, as seen from the rotating shaft direction of the second roller.

8. The medium transport apparatus according to claim 1, wherein when the gate is in the first state, a portion of the first roller protrudes from the first route member toward the second route member at a location upstream of the gate in the medium transport direction, as seen from the rotating shaft direction of the first roller, and the portion of the first roller is positioned so as not to come into contact with the medium being guided by the first route member between the first roller and the second roller.

9. The medium transport apparatus according to claim 1, wherein when the gate is in the first state, a portion of the second roller protrudes from the second route member toward the first route member at a location upstream of the gate in the medium transport direction, as seen from the rotating shaft direction of the second roller, and the portion of the second roller is positioned so as not to come into contact with the medium being guided by the second route member between the first roller and the second roller.

10. The medium transport apparatus according to claim 1, wherein at least one of the first roller and the second roller is a toothed roller.

11. A medium processing apparatus comprising:

the medium transport apparatus according to claim 1; and a processing section that processes a medium transported by the medium transport apparatus.

12. A recording apparatus comprising:

the medium transport apparatus according to claim 10;

a recording section that performs recording onto a surface of a medium which is in contact with the second roller by discharging a liquid onto the surface; and a reverse route along which the medium on which the information was recorded by the recording section is to be turned over and fed to the medium transport apparatus, the first roller being the toothed roller.

* * * * *